US008083625B2

(12) United States Patent
Terada

(10) Patent No.: US 8,083,625 B2
(45) Date of Patent: Dec. 27, 2011

(54) DRIVING FORCE TRANSMISSION DEVICE AND IMAGE RECORDING APPARATUS HAVING THE SAME

(75) Inventor: Kohei Terada, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 694 days.

(21) Appl. No.: 12/261,893

(22) Filed: Oct. 30, 2008

(65) Prior Publication Data

US 2009/0111638 A1 Apr. 30, 2009

(30) Foreign Application Priority Data

Oct. 30, 2007 (JP) ..... 2007-282514
Sep. 22, 2008 (JP) ..... 2008-242595

(51) Int. Cl.
*F16H 3/72* (2006.01)
*F16H 37/08* (2006.01)

(52) U.S. Cl. ..... 475/5; 475/6; 475/221

(58) Field of Classification Search ..... 475/6, 9, 475/150

See application file for complete search history.

(56) References Cited

U.S. PATENT DOCUMENTS 4,811,627 A * 3/1989 Mouille ..... 74/665 L
5,158,376 A 10/1992 Alessandro et al.
5,801,744 A 9/1998 Taniguchi et al.
2006/0111213 A1* 5/2006 Bucknor et al. ..... 475/5
2006/0148605 A1* 7/2006 Raghavan et al. ..... 475/5
2007/0155575 A1* 7/2007 Hamilton ..... 475/221

FOREIGN PATENT DOCUMENTS

JP H05-050698 A 3/1993
JP H05-149392 A 6/1993
JP H05-338310 A 12/1993
JP H06-024087 A 2/1994
JP H06-079952 A 3/1994
JP H06-123337 A 5/1994
JP H06-213301 A 8/1994
JP H08-267871 A 10/1996
JP 2002-103729 A 4/2002
WO 02/083483 A1 10/2002

* cited by examiner

*Primary Examiner* — Edwin A Young
(74) *Attorney, Agent, or Firm* — Baker Botts L.L.P.

(57) ABSTRACT

A driving force transmission device is provided. The device includes: a first differential unit and a second differential unit. The first differential unit includes: first and second input shafts connected to a first motor and a second motor, respectively, and a first output shaft connected to a first driven member. The second differential unit includes: third and fourth input shafts connected to the first motor and the second motor, respectively, and a second output shaft connected to a second driven member. An angular speed of the first output shaft is a sum of a times a first angular speed of the first motor and b times the second angular speed of a second motor. An angular speed of the second output shaft is a sum of c times the first angular speed and d times the second angular speed. a, b, c and d satisfy a relation of $ad-bc\neq 0$.

11 Claims, 9 Drawing Sheets

DRIVING FORCE TRANSMISSION DEVICE AND IMAGE RECORDING APPARATUS HAVING THE SAME

CROSS-REFERENCE TO RELATED APPLICATION

This application claims priority from Japanese Patent Application No. 2007-282514, filed on Oct. 30, 2007, and Japanese Patent Application No. 2008-242595, filed on Sep. 22, 2008, the entire subject matters of which are incorporated herein by reference.

TECHNICAL FIELD

Aspects of the present invention relate to a driving force transmission device for transmitting driving force of two motors to a first driven member and a second driven member and an image recording apparatus having the driving force transmission device.

BACKGROUND

An image recording apparatus of ink-jet recording type prints an image on a recording sheet by ejecting ink drops onto the recording sheet. In such a type of image recording apparatuses, a carriage mounting thereon a print head is supported to be movable in a direction perpendicular to a conveyance direction of a recording sheet. The carriage moves at a specific moving speed with the driving force from a carriage driving motor (hereinafter, referred to as "CR motor"). On the other hand, the recording sheet on which an image is printed is conveyed below the carriage by a conveyance roller. The conveyance roller rotates at a specific angular speed with the driving force from a conveyance roller driving motor (hereinafter, referred to as "LF motor").

FIG. 9 is a block diagram schematically illustrating a configuration of a feedback control system applied to an image recording apparatus. In FIG. 9, a flow of an electrical signal is indicated by a dashed line and a flow of driving force is indicated by a thick solid line. As shown in FIG. 9, in the control system, an LF motor 211 and a CR motor 221 are controlled by independent control systems, respectively.

As shown in FIG. 9, the driving current $I_{LF}$ is supplied from a motor driver 201 to the LF motor 211 so that a conveyance roller 213 is driven at a specific target angular speed. The driving force of the LF motor 211 is transmitted to the conveyance roller 213 through a gear driving mechanism 212. Accordingly, the conveyance roller 213 rotates. The actual angular speed of the conveyance roller 213 is measured by an optical sensor 215 such as a rotary encoder. The measured angular speed is fed back to the motor driver 201. The motor driver 201 calculates the difference between the fed-back angular speed and the target angular speed and adjusts the value of the driving current $I_{LF}$ so that the actual angular speed gets close to the target angular speed. The CR motor 221 is controlled by a motor driver 202 in feedback manner. Specifically, the driving current $I_{CR}$ is supplied from the motor driver 202 to the CR motor 221 so that the carriage 223 is driven at a specific target moving speed. The driving force of the CR motor 221 is transmitted to the carriage 223 through a belt driving mechanism 222. Accordingly, the carriage 223 is made to move. The actual moving speed of the carriage 223 is measured by an optical sensor 225 such as a linear encoder. The measured moving speed is fed back to the motor driver 202. The motor driver 202 calculates the difference between the fed-back moving speed and the target moving speed and adjusts the driving current $I_{CR}$ so that the actual moving speed gets close to the target moving speed.

In the above-described image recording apparatus, an image printing operation is performed as follows. First, until the leading end of a printing area of a recording sheet reaches the bottom of a print head, the recording sheet is conveyed by the conveyance roller with the driving force of the LF motor. When the leading end of the printing area reaches the bottom of the print head, the LF motor is paused and the recording sheet is stopped. By driving the CR motor in this state, the carriage located at a standby position is made to move. In the course of the movement, the print head selectively ejects ink drops from nozzles while moving along with the carriage. Accordingly, a one-line image is printed on the recording sheet. When the carriage reaches the standby position, the CR motor is paused. Thereafter, the LF motor is intermittently driven and the conveyance roller conveys the recording sheet by a specific width corresponding to one line. Accordingly, the recording sheet is paused every time when the recording sheet is conveyed by the specific width. During the pause, the carriage is made to move and one-line image is printed on the recording sheet. By repeating this operation, a continuous image including specific lines is printed on the recording sheet.

Recently, in such image recording apparatuses, the print head tends to increase in size with the increase of the number of nozzles of the print head or the number of available ink colors. For the purpose of reducing the printing time, the moving speed of the carriage tends to increase. The increase in size of the print head or the increase in moving speed of the carriage causes an increase in load of the CR motor driving the carriage. Accordingly, it is necessary to employ a higher-power motor as the CR motor. When a recording sheet having a thick such as glossy paper having been subjected to a gloss process is conveyed or when the conveyance roller is made to rotate at a high speed to reduce the printing time, the load of the LF motor driving the conveyance roller increases. Accordingly, it is necessary to employ a high-power motor as the LF motor.

As a device for transmitting the driving force of a motor to a specific driven member, JP-A-6-213301 describes a differential gear and JP-A-6-123337 describes a reduction gear. In the former differential gear, two motors are connected through a belt or pulley and the driving force of two motors is output from one output shaft. The latter reduction gear includes plural input shafts to which the rotational force is input, plural output shafts from which the rotational power is output, and a differential gear element interposed therebetween to obtain plural reduced rotation outputs from plural rotation inputs.

When a high-power motor is employed, the motor increases in size, thereby causing an increase in size of the image recording apparatus as a whole. Employing the high-power motor may cause the increase in cost and in power consumption. Accordingly, these days when the decrease in cost, size, and power consumption of the image recording apparatus are strongly required, it is not preferable that high-power motors are employed every driven member since it is opposite to the requirement. The requirement for the decrease in cost, size, and power consumption is also applied to devices having plural motors such as vehicles, industrial robots, portable terminals, and note-type personal computers, as well as the image recording apparatus.

SUMMARY

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the present invention to provide a driving force transmission device that can produce a desired rotation output without any increase in size of a motor, and an image recording apparatus having the driving force transmission device.

According to an exemplary embodiment of the present invention, there is provided a driving force transmission device for transmitting driving force of a first motor and a second motor, angular speeds of which are controlled independently, to a first driven member and a second driven member. The driving force transmission device includes: a first differential unit and a second differential unit. The first differential unit includes a first input shaft connected to a first rotation shaft of the first motor, a second input shaft connected to a second rotation shaft of the second motor; and a first output shaft connected to the first driven member. The second differential unit includes, a third input shaft connected to the first rotation shaft of the first motor, a fourth input shaft connected to the second rotation shaft of the second motor, and a second output shaft connected to the second driven member. An angular speed of the first output shaft is a sum of a times the angular speed of the first motor and b times the angular speed of the second motor. An angular speed of the second output shaft is a sum of c times the angular speed of the first motor and d times the angular speed of the second motor. The a, b, c and d satisfy a relation of $ad-bc\neq 0$.

According to another exemplary embodiment of the present invention, there is provided an image recording apparatus including: a first motor; a second motor; a controller configured to control angular speeds of the first motor and the second motor; a carriage which includes a print head and reciprocates in a first direction; a conveyance roller which conveys a recording medium in a second direction intersecting the first direction to an image printing area of the print head; a driving force transmission device for transmitting driving force of the first motor and the second motor to the carriage and the conveyance roller. The driving force transmission device includes a first differential unit and a second differential unit. The first differential unit includes a first input shaft connected to a first rotation shaft of the first motor, a second input shaft connected to a second rotation shaft of the second motor, and a first output shaft connected to a driving mechanism of the carriage. The second differential unit includes, a third input shaft connected to the first rotation shaft of the first motor, a fourth input shaft connected to the second rotation shaft of the second motor, and a second output shaft connected to a driving mechanism of the conveyance roller. An angular speed of the first output shaft is a sum of a times the angular speed of the first motor and b times the angular speed of the second motor. An angular speed of the second output shaft is a sum of c times the angular speed of the first motor and d times the angular speed of the second motor. The a, b, c and d satisfy a relation of $ad-bc\neq 0$.

According to a further exemplary embodiment of the present invention, there is provided an image recording apparatus including: a first motor; a second motor; a conveyance unit which conveys a recording medium in a conveying direction; a carriage which reciprocates in a scanning direction intersecting the conveying direction and mounts thereon a print head for ejecting drops on the recording medium; and a driving force transmission device which generates a first driving force for the conveyance unit from a driving force of the first motor and a driving force of the second motor in conjunction with each other, and which generates a second driving force to the carriage from the driving force of the first motor and the driving force of the second motor in conjunction with each other, the second driving force being independent from the first driving force.

BRIEF DESCRIPTION OF THE DRAWINGS

The above and other aspects of the present invention will become more apparent and more readily appreciated from the following description of exemplary embodiments of the present invention taken in conjunction with the attached drawings, in which.

DETAILED DESCRIPTION

Figure 1:
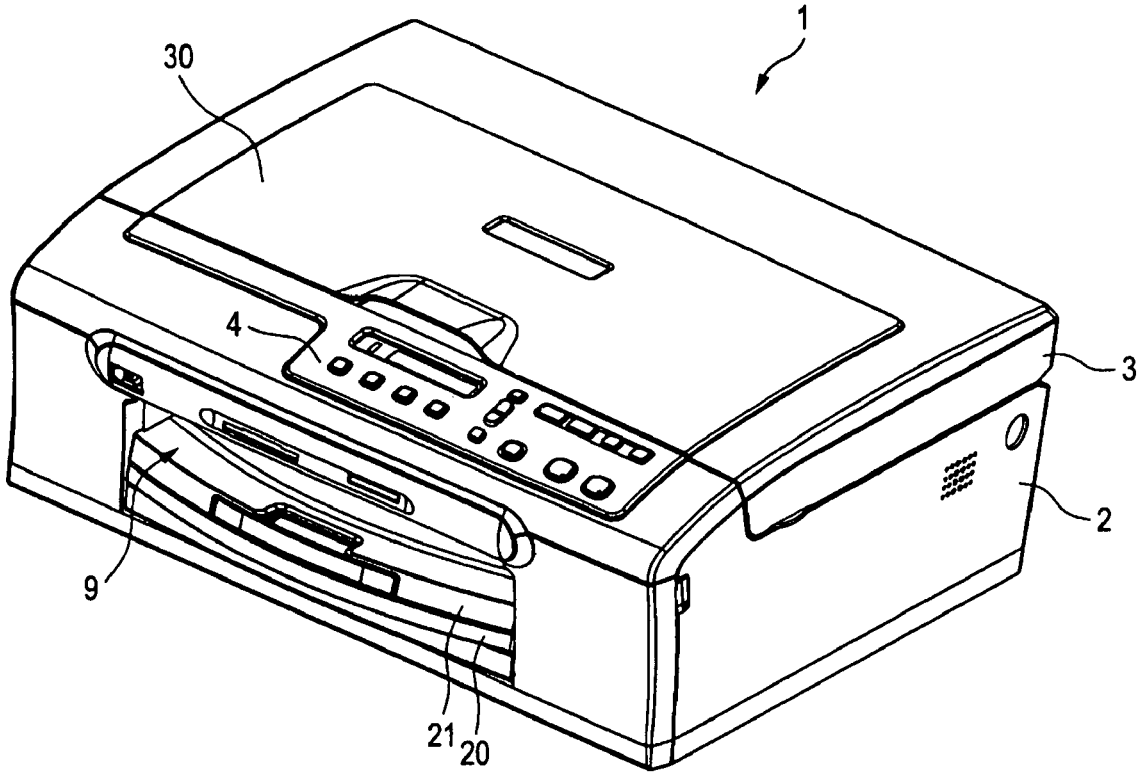
FIG. 1 is a perspective view illustrating an appearance of a multi function peripheral according to an exemplary embodiment.
Figure 2:
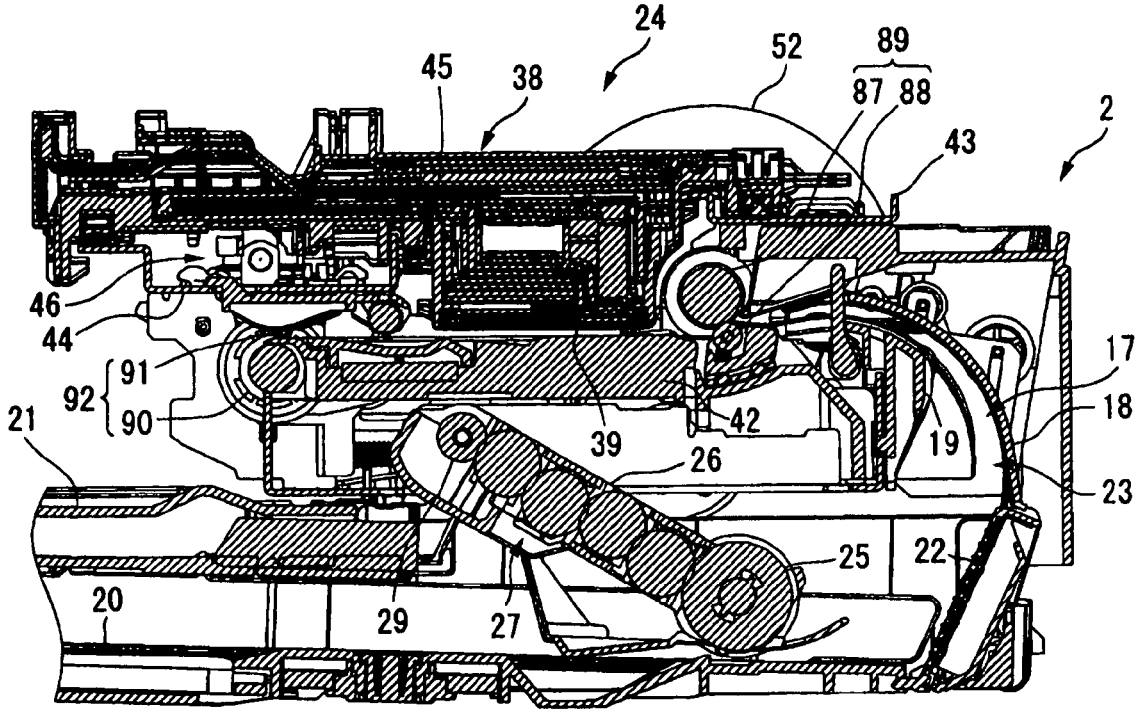
FIG. 2 is a partially-enlarged sectional view illustrating a configuration of a printer unit in the multi function peripheral.
Figure 3:
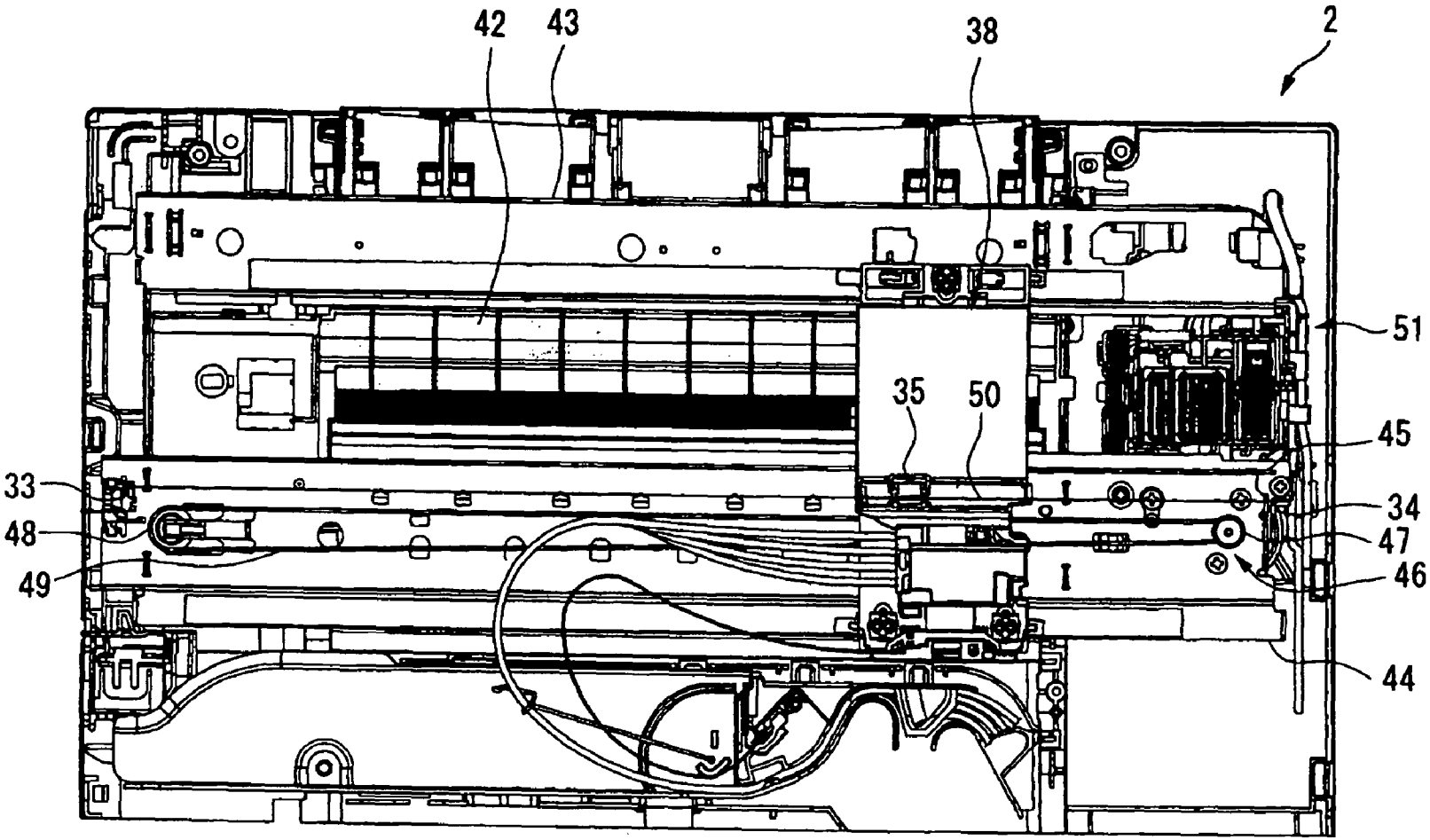
FIG. 3 is a plan view illustrating the configuration of the printer unit at substantially from the center thereof to a rear of the multi function peripheral.
Figure 4:
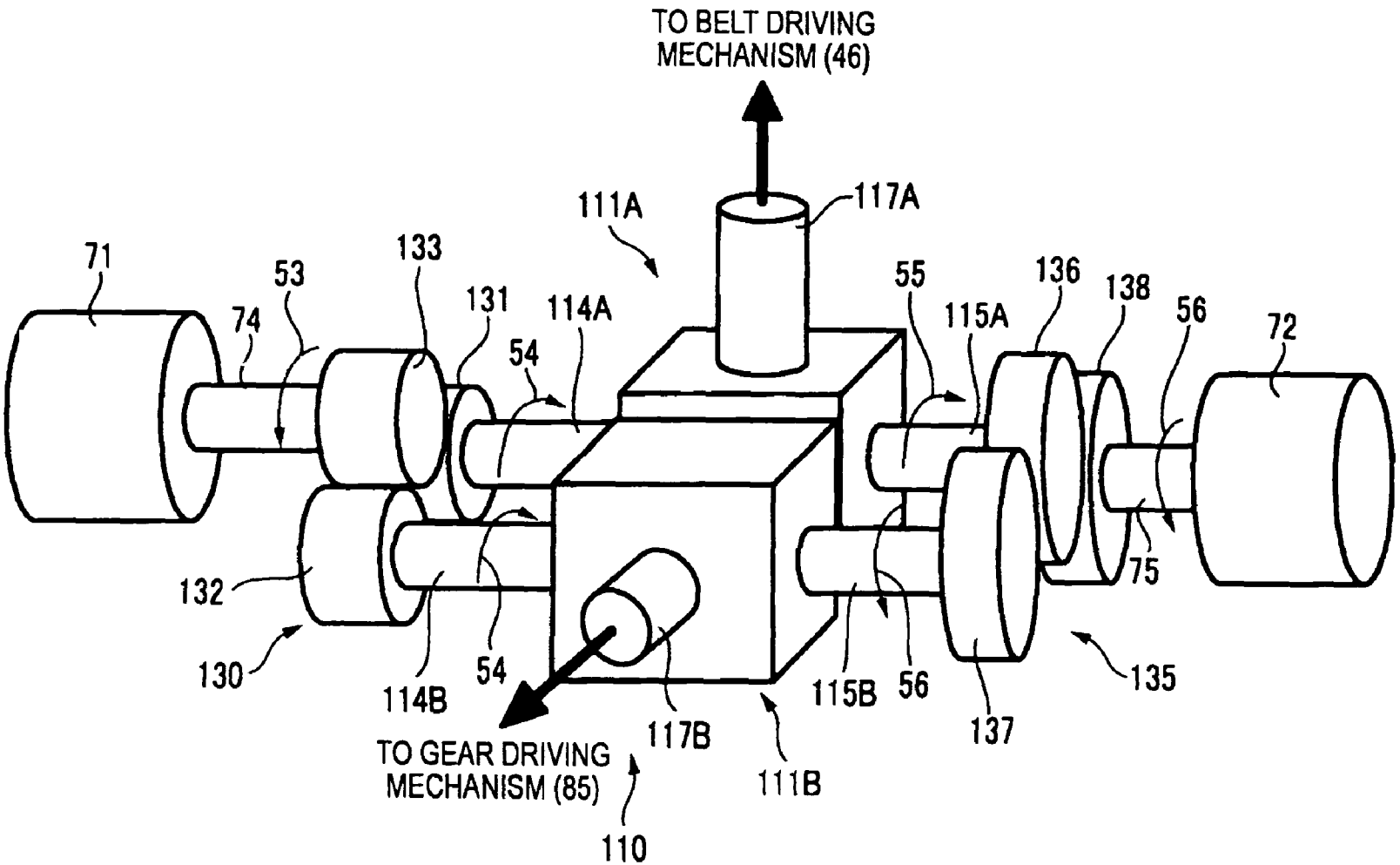
FIG. 4 is a model diagram schematically illustrating a differential transmission mechanism.
Figure 5:
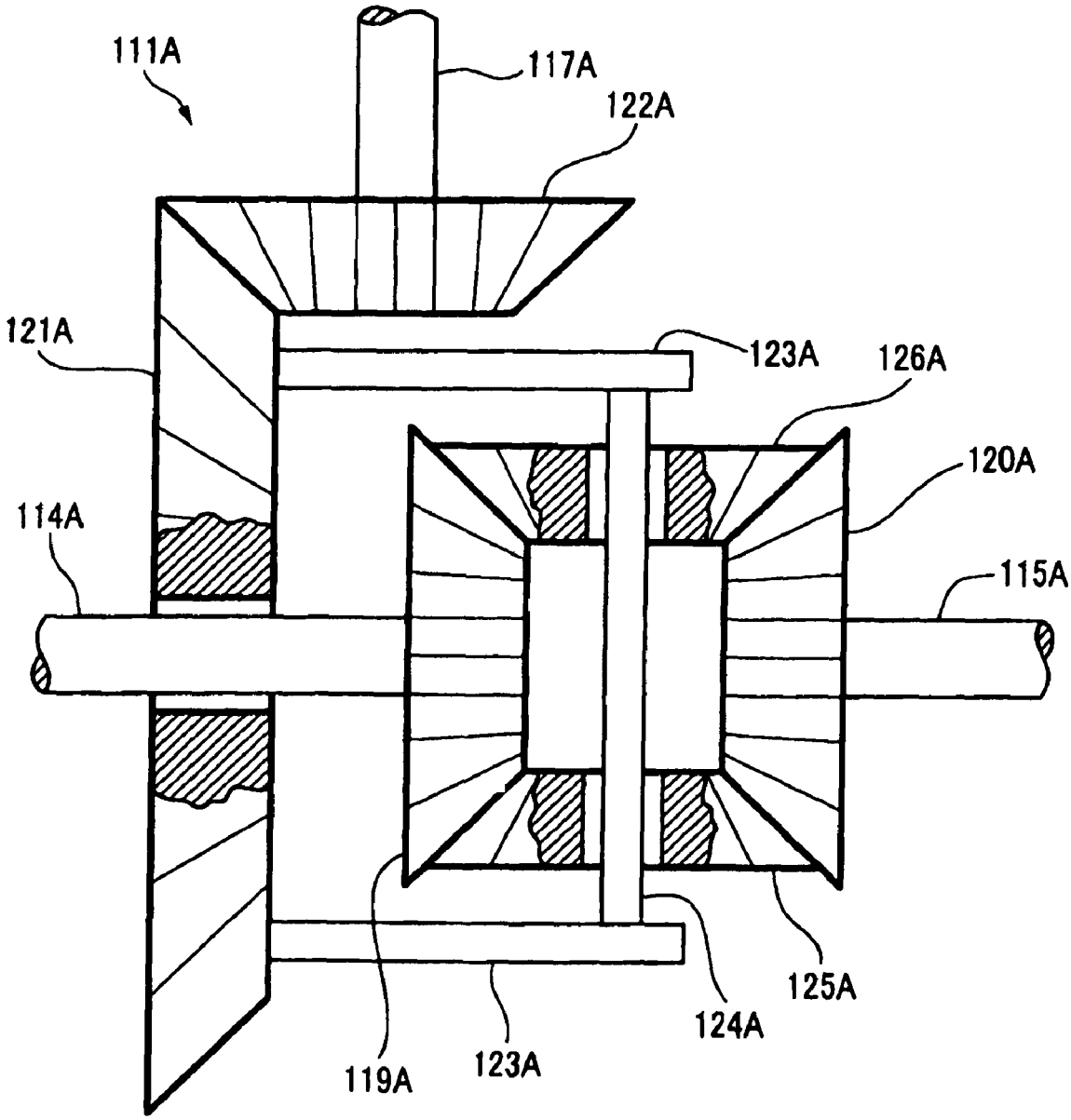
FIG. 5 is a diagram schematically illustrating a configuration of a differential gear.
Figure 6:
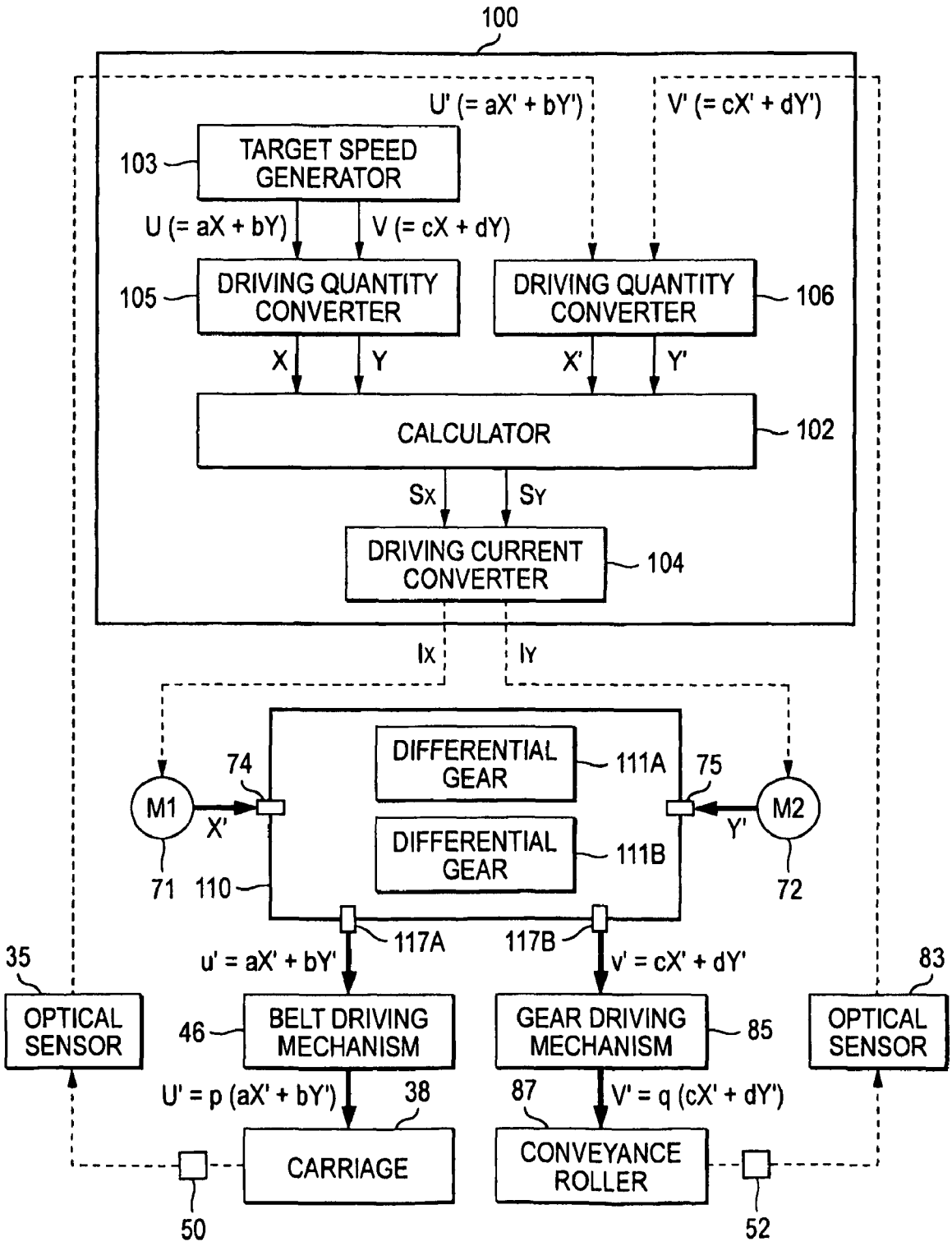
FIG. 6 is a block diagram schematically illustrating a configuration for motor driving control using a motor driver.
Figure 7:
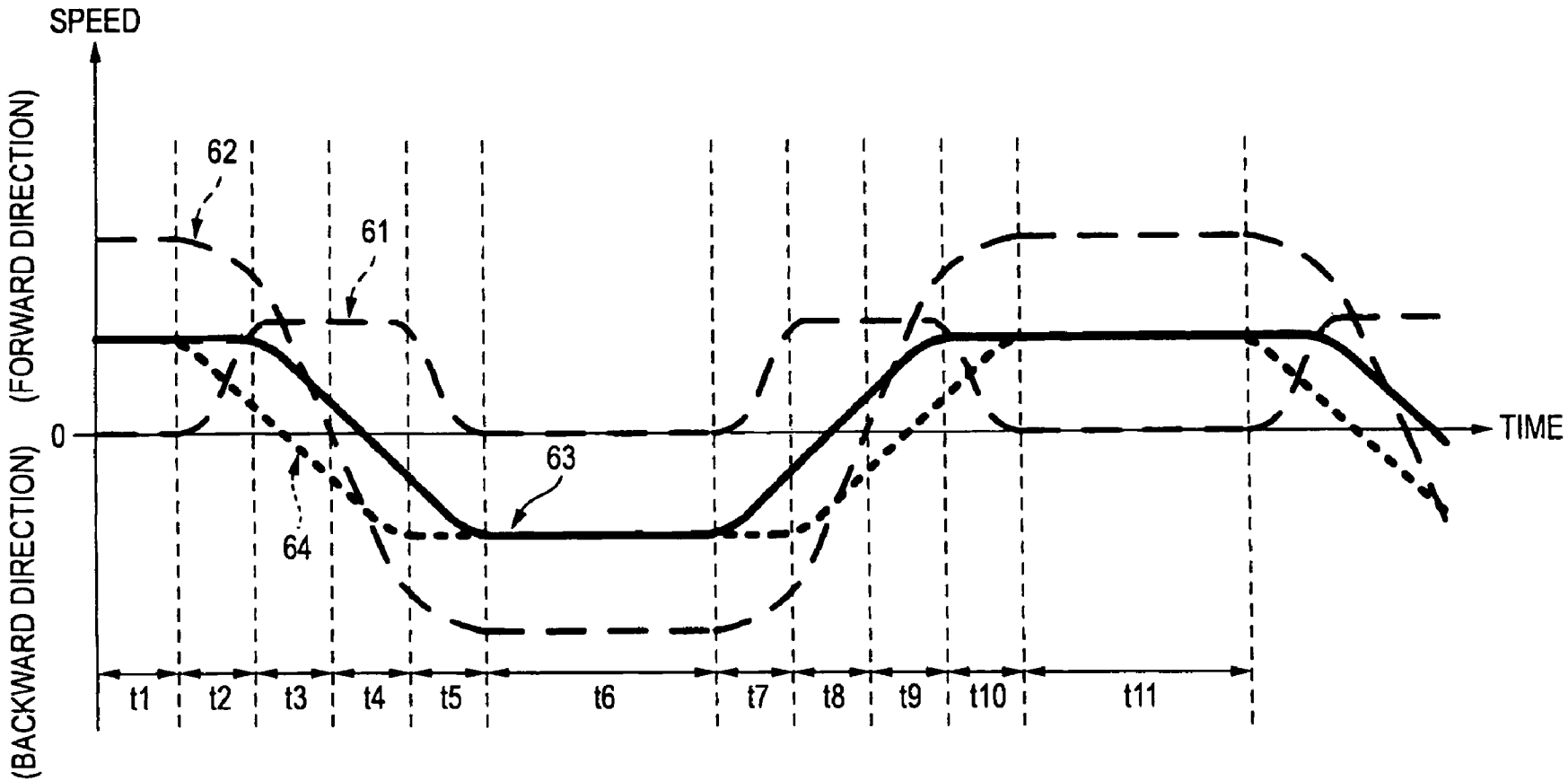
FIG. 7 is a graph illustrating speed characteristics (change in speed) of a carriage, a conveyance roller, a first motor, and a second motor.
Figure 8:
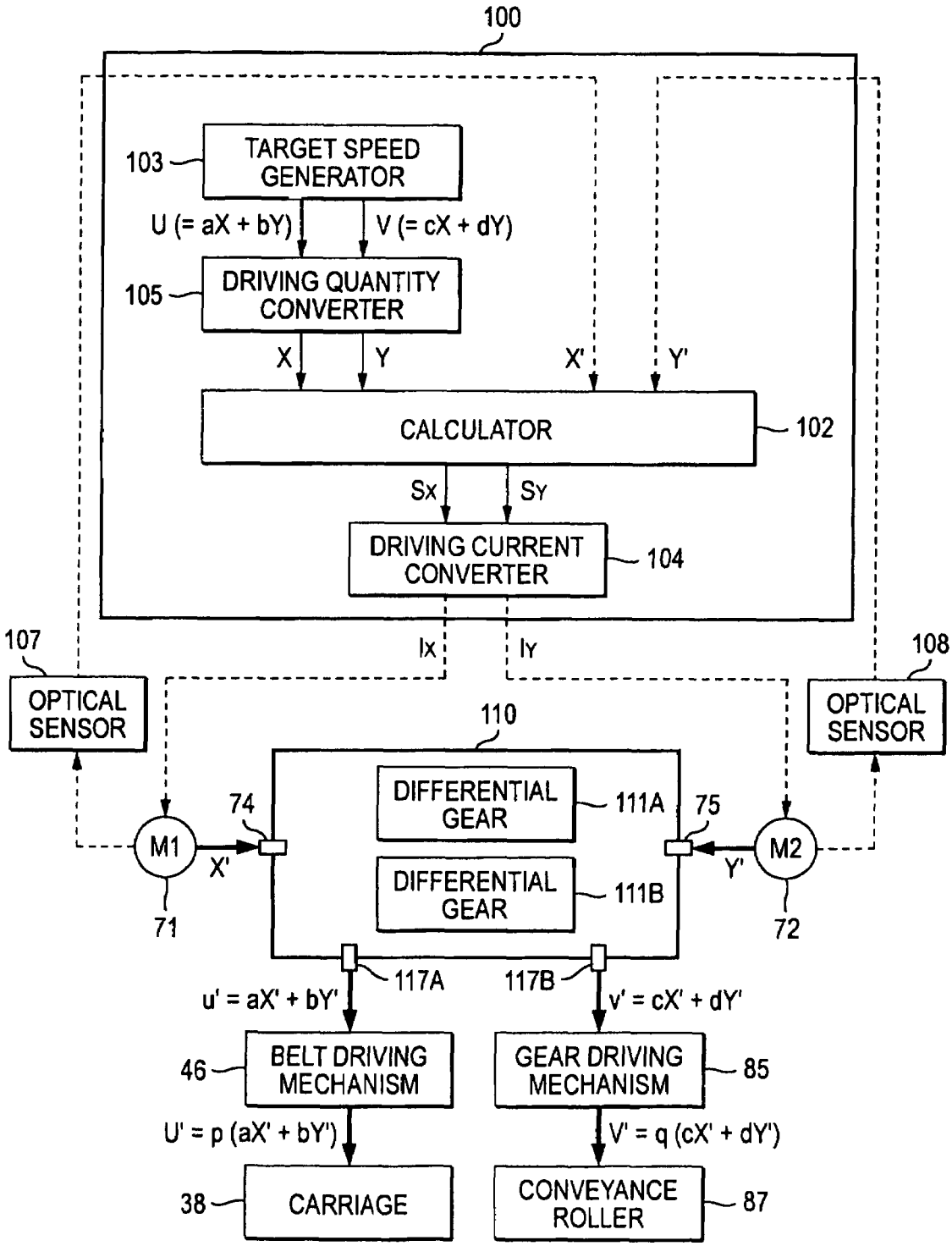
FIG. 8 is a block diagram schematically illustrating a configuration for motor driving control according to a modified exemplary embodiment of the present invention.
Figure 9:
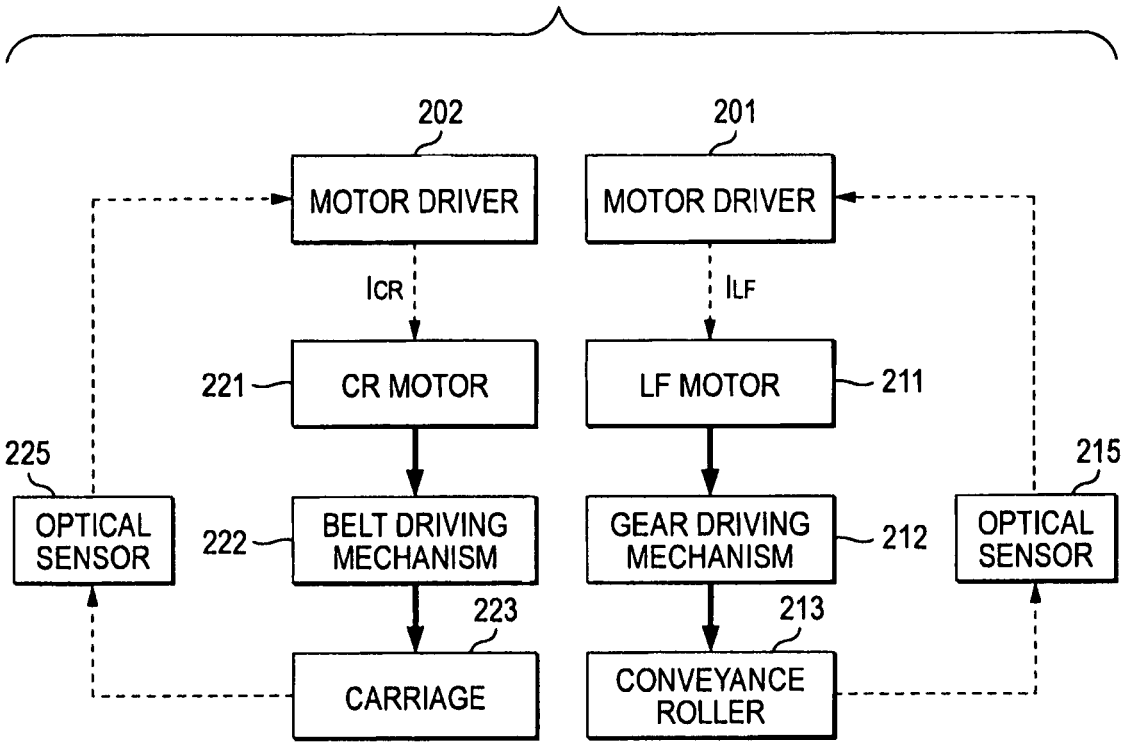
FIG. 9 is a block diagram schematically illustrating a configuration of a related-art feedback control system applied to a related-art image recording apparatus.

Hereinafter, exemplary embodiments of the present invention will be described with reference to the accompanying drawings. FIG. 1 is a perspective view illustrating an appearance of a multi function peripheral 1. FIG. 2 is a partially-enlarged sectional view illustrating a configuration of a printer unit 2. FIG. 3 is a plan view illustrating the main configuration of the printer unit 2 at substantially from the center thereof to a rear of the multi function peripheral 1. FIG. 4 is a model diagram schematically illustrating a differential transmission mechanism 110. FIG. 5 is a diagram schematically illustrating a configuration of a differential gear 111A. FIG. 6 is a block diagram schematically illustrating a configuration for motor driving control using a motor driver 100. In FIG. 6, a flow of an electrical signal is indicated by a dashed line and a flow of a driving force is indicated by a thick solid line. FIG. 7 is a graph illustrating speed characteristics (change in speed) of a carriage 38, a conveyance roller 87, a first motor 71, and a second motor 72. FIG. 8 is a block diagram schematically illustrating a configuration for motor driving control according to a modified example of an embodiment of the invention. In FIG. 7, the change in angular speed of the conveyance roller 87 is indicated by a dashed line 61 and the change in moving speed of the carriage 38 is indicated by a dashed line 62. The change in angular speed of the rotation shaft 74 of the first motor 71 is indicated by a solid line 63 and the change in angular speed of the rotation shaft 75 of the second motor 72 is indicated by a dotted line 64.

Multi Function Peripheral 1

A multi function peripheral (MFP) 1 includes a printer unit 2 and a scanner unit 3, and has a printing function, a scanning function, a copying function and a facsimile function. The configuration other than the printing function is arbitrary, and for example, the image recording apparatus according to an exemplary embodiment may be embodied as a printer having only the printing function, but not including the scanner unit 3.

As shown in FIG. 1, the multi function peripheral 1 has a substantially rectangular parallelepiped shape. The lower portion of the multi function peripheral 1 serves as the printer unit 2 and the upper portion thereof serves as the scanner unit 3.

The printer unit 2 of the multi function peripheral 1 is connected to an external information device such as a computer and records an image or document on a recording sheet based on print data including image data or document data transmitted from the computer. The printer unit 2 has an opening 9 formed in the front face thereof. A sheet feeding tray 20 and a sheet discharging tray 21 are provided in the opening 9 in two vertical stages. A recording sheet accommodated in the sheet feeding tray 20 is fed to the inside of the printer unit 2, a desired image is printed on the recording sheet, and then the recording sheet on which the image has been printed is discharged to the sheet discharging tray 21.

The scanner unit 3 is configured as a flat bed scanner. A document cover 30 as a top plate of the multi function peripheral 1 is disposed above the scanner unit 3 so as to be freely opened and closed. A platen glass and an image sensor (not shown) are disposed below the document cover 30. The image of the document placed on the platen glass is read by the image sensor. Since the scanner unit 3 does not relate to the exemplary embodiment of the present invention, the detailed description of the scanner unit 3 is omitted herein.

As shown in FIG. 1, an operation panel 4 for operating the printer unit 2 or the scanner unit 3 is disposed in the front upper portion of the multi function peripheral 1. The operation panel 4 includes a variety of operation buttons and a liquid crystal display unit. The multi function peripheral 1 operates in accordance with the operating instruction from the operation panel 4. When the multi function peripheral 1 connected to an external computer, the multi function peripheral 1 also operates in accordance with an instruction transmitted from the computer through a printer driver or a scanner driver.

Printer Unit 2

The inner configuration of the multi function peripheral 1, specifically, the printer unit 2, will be described now.

As shown in FIG. 2, a sheet feeding tray 20 is provided in the bottom portion of the multi function peripheral 1. A feed roller 25 is provided above the sheet feeding tray 20. The feed roller 25 is rotatably supported by an end of a feed arm 26, an end of which is rotatably supported by a base shaft 29. A gear driving mechanism 27 for transmitting the rotational driving force input from the base shaft 29 to the feed roller 25 is provided in the feed arm 26. A first motor 71 and a second motor 72 (see FIG. 6) are provided in the printer unit 2. The motors 71 and 72 can be rotationally driven forward and backward, respectively. The rotation driving force of the motors 71 and 72 is transmitted to the feed roller 15 through a differential transmission mechanism 110 (see FIG. 4) to be described later, the base shaft 29, and the gear driving mechanism 27. Accordingly, the feed roller 25 is rotationally driven. The motors 71 and 72 are used as a driving source for driving a conveyance roller 87 and a carriage 38 described later, as well as the feed roller 25.

A slope plate 22 is disposed inside the sheet feeding tray 20. When the feed roller 25 rotates in a state where the feed roller 25 comes in press contact with the recording sheet on the sheet feeding tray 20, the uppermost recording sheet is sent out to the slope plate 22 by the frictional force between the roller surface of the feed roller 25 and the recording sheet. The leading end of the recording sheet comes in contact with the slope plate 22 and is guided upward. A sheet conveying path 23 extends from the slope plate 22. Specifically, the sheet conveying path 23 is directed to the upside from the slope plate 22, is bent to the front surface of the multi function peripheral 1, extends from the rear face of the multi function peripheral 1 to the front face thereof, passes through the lower portion of the image printing unit 24, and extends to the sheet discharging tray 21. Accordingly, the recording sheet accommodated in the sheet feeding tray 20 is guided from the downside to the upside along the sheet conveying path 23 to form a U shape and reaches the image printing unit 24. An image is printed on the recording sheet by the image printing unit 24 and then the recording sheet is discharged to the sheet discharging tray 21.

As shown in FIG. 2, the image printing unit 24 is disposed in the sheet conveying path 23. The image printing unit 24 includes an ink-jet print head 39 and a carriage 38 mounting thereon the print head 39. The carriage 38 is supported to be movable in a main scanning direction (direction perpendicular to the drawing surface of FIG. 2) perpendicular to the conveyance direction of the recording sheet.

The print head 39 is provided in the bottom of the carriage 38 and nozzles of the print head 39 are exposed from the bottom surface of the carriage 38. Color ink is supplied to the print head 39 from an ink cartridge (not shown) disposed in the multi function peripheral 1. While the carriage 38 is reciprocating, ink drops of the color ink are selectively ejected from the nozzles of the print head 39. Accordingly, an image is printed on the recording sheet conveyed over the platen 42.

As shown in FIG. 3, a pair of guide rails 43 and 44 is disposed above the sheet conveying path 23. The guide rails 43 and 44 are opposed to each other with a specific distance therebetween in the conveyance direction (from the upside to the downside in FIG. 3) of the recording sheet and extend in the main scanning direction (lateral direction in FIG. 3) perpendicular to (intersecting with) the conveyance direction of the recording sheet. The guide rails 43 and 44 are disposed in the chassis of the printer unit 2 and form a part of a frame for supporting the members of the printer unit 2. The carriage 38 is suspended on the guide rails 43 and 44 so as to slidably move in the main scanning direction.

The guide rail 43 is disposed upstream in the conveyance direction of the recording sheet. The guide rail 43 has a plate shape, a length of which in the width direction (lateral direction in FIG. 3) of the sheet conveying path 23 is greater than the reciprocating range of the carriage 38. The guide rail 44 is disposed downstream in the conveyance direction of the recording sheet. The guide rail 44 has a plate shape a length of which in the width direction of the sheet conveying path 23 is substantially equal to that of the guide rail 43. An end of the carriage 38 at the upstream in the conveyance direction is placed on the guide rail 43 and an end of the carriage 38 at the downstream in the conveyance direction is placed on the guide rail 44, whereby the carriage 38 slidably moves in the longitudinal direction of the guide rails 43 and 44.

An edge portion 45 of the guide rail 44 at the upstream in the conveyance direction is bent upward to form substantially the right angle. The carriage 38 includes interposing members such as a roller pair which interposes the edge portion 45 so as to slidably move. Accordingly, the carriage 38 is positioned in the conveyance direction of the recording sheet and can slidably move in the main scanning direction perpendicular to the conveyance direction of the recording sheet. In other words, the carriage 38 is slidably held on the guide rails 43 and 44 and reciprocates in the main scanning direction perpendicular to the conveyance direction of the recording sheet along the edge portion 45 of the guide rail 44.

As shown in FIG. 3, a belt driving mechanism 46 is provided on the upper surface of the guide rail 44. The belt driving mechanism 46 includes a driving pulley 47, a driven pulley 48, and an endless annular belt 49. In this exemplary embodiment, for the purpose of explanation convenience, a transmission ratio p of the belt driving mechanism 46, that is, a value obtained by dividing the output of the belt driving mechanism 46 by the input thereof, is set to "1." Needless to say, the transmission ratio p can be properly changed to a value depending on the operation or moving speed of the carriage 38.

The driving pulley 47 and the driven pulley 48 are provided in the vicinities of both ends, respectively, in the width direction of the sheet conveying path 23. The endless annular belt 49 is suspended between the driving pulley 47 and the driven pulley 48. The rotational driving force of the first motor 71 and the second motor 72 (see FIG. 6) is transmitted to the shaft of the driving pulley 47 through a differential transmission mechanism 110 (see FIG. 4) to be described later. Accordingly, the driving pulley 47 is rotated. The belt 49 circumferentially moves with the rotation of the driving pulley 47. The belt 49 is not limited to the endless annular shape, but a shape in which both ends of an ended belt are secured to the carriage 38 may be employed.

The bottom of the carriage 38 is connected to the belt 49. Accordingly, the carriage 38 moves on the guide rails 43 and 44 along the edge portion 45 with the circumferential movement of the belt 49. The print head 39 is mounted on the carriage 38 and the print head 39 reciprocates in the width direction of the sheet conveying path 23 as the main scanning direction.

As shown in FIG. 3, an encoder strip 50 is provided in the guide rail 44. The encoder strip 50 has a band shape made of transparent resin. The encoder strip 50 has a pattern in which a light transmitting portion and a light blocking portion are alternately arranged at an equal interval. A pair of support ribs 33 and 34 is formed at both ends in the width direction (moving direction of the carriage 38) of the guide rail 44 so as to rise up from the top surface thereof. Ends of the encoder strip 50 engage with the support ribs 33 and 34, respectively and the encoder strip extends along the edge portion 45. The encoder strip 50 is applied with a tension by a spring and the like.

On the top surface of the carriage 38, an optical sensor 35 is disposed at a position corresponding to the encoder strip 50. The optical sensor 35 includes a light emitting element and a light receiving element. The encoder strip 50 is interposed between the light emitting element and the light receiving element of the optical sensor 35. The encoder strip 50 and the optical sensor 35 configure a linear encoder for detecting the position of the carriage 38. In this exemplary embodiment, by allowing the optical sensor 35 to read the pattern of the encoder strip 50, it is possible to acquire a detection signal indicating position information of the carriage 38. The detection signal is input to a motor driver 100 (see FIG. 6) to be described later and is used for the driving control of the first motor 71 and the second motor 72 (see FIG. 6).

As shown in FIGS. 2 and 3, a platen 42 is provided below the sheet conveying path 23 to be opposed to the print head 39. The platen 42 is disposed to cover the center portion, where the recording sheet passes, in the movement range of the carriage 38. The width of the platen 42 is sufficiently greater than the maximum width of the recording sheet to be conveyed and both ends of the recording sheet always passes over the platen 42.

As shown in FIG. 3, a maintenance mechanism 51 is provided in a range through which the recording sheet does not pass, that is, outside an image printing area by the print head 39. Specifically, the maintenance mechanism 51 is disposed at the right end of the platen 42 in FIG. 3. The maintenance mechanism 51 serves to prevent the ink in the nozzles of the print head 39 from drying or to suction and remove bubbles or particles from the nozzles. In this exemplary embodiment, when an image printing operation is not performed, the carriage 38 waits on the maintenance mechanism 51 until an image printing instruction is input.

As shown in FIG. 2, a conveyance roller pair 89 including a conveyance roller 87 and a pinch roller 88 is provided upstream from the image printing unit 24. A discharge roller pair 92 including a discharge roller 90 and a spur 91 disposed above the discharge roller 90 is provided downstream from the image printing unit 24. The gear driving mechanism 85 including plural gears (see FIG. 6) is connected to the shaft of the conveyance roller 87. In this exemplary embodiment, for the purpose of explanation convenience, the transmission ratio (gear ratio) q of the gear driving mechanism 85, that is, a value obtained by dividing the output of the gear driving mechanism 85 by the input thereof, is set to "1." Needless to say, the transmission ratio q can be properly changed to any value depending on the operation or angular speed of the conveyance roller 87.

The rotational driving force of the first motor 71 and the second motor 72 (see FIGS. 4 and 6) is transmitted to the shaft of the conveyance roller 87 through the differential transmission mechanism 110 (see FIG. 4) to be described later and the gear driving mechanism 85. Accordingly, the conveyance roller 87 rotates at a specific angular speed and the recording sheet is conveyed along the sheet conveying path 23. The conveyance roller 87 and the discharge roller 90 are connected to each other through a transmission mechanism such as a gear, and the driving force of the conveyance roller 87 is transmitted to the discharge roller 90 through the transmission mechanism. Accordingly, the conveyance roller 87 and the discharge roller 90 are driven in synchronization with each other. While the recording sheet is intermittently being conveyed by the conveyance roller 87, the feed roller 25 and the differential transmission mechanism 110 are separated from each other and thus the feed roller 25 is not rotated.

The recording sheet conveyed along the sheet conveying path 23 is conveyed onto the platen 42 by the conveyance roller pair 89. The recording sheet on which an image has been printed on the platen 42 is conveyed to the sheet discharging tray 21 by the discharge roller pair 92.

An encoder disk 52 is provided on the rotation shaft of the conveyance roller 87. The encoder disk 52 has a pattern in which a light blocking portion and a light transmitting portion are alternately arranged in the circumferential edge thereof. An optical sensor 83 (see FIG. 6) is provided at a position corresponding to the circumferential edge of the encoder disk 52. The optical sensor 83 includes a light emitting element and a light receiving element. The circumferential edge of the encoder disk 52 is interposed between the light emitting element and the light receiving element of the optical sensor 83. The encoder disk 52 and the optical sensor 83 configure a rotary encoder for detecting the rotation position of the conveyance roller 87. In this exemplary embodiment, the pattern of the encoder disk 52 rotating along with the conveyance roller 87 is read by the optical sensor 83. By allowing the optical sensor 83 to read the pattern of the encoder disk 52, a detection signal indicating rotation position information of the conveyance roller 87 can be acquired. The detection signal is input to a motor driver 100 (see FIG. 6) to be described later and is used for the driving control of the first motor 71 and the second motor 72 (see FIGS. 4 and 6).

In this exemplary embodiment, when an image printing instruction is input to the multi function peripheral 1 and the leading end of the printing area of the recording sheet reaches the lower side of the print head 39, the conveyance roller 87 is intermittently rotated by a specific linefeed width and thus the recording sheet is intermittently conveyed by the same width. Specifically, according to the speed characteristic (see the dashed line 61) of the conveyance roller 87 shown in FIG. 7, the rotation and the pause of the conveyance roller 87 are repeated with a specific interval. Specifically, the conveyance roller 87 is stopped in interval t1, is accelerated in interval t2, is driven at a constant angular speed from interval t3 to interval t4, is decelerated at interval t5, and is stopped again at interval t6. In intervals t7 and t11 and intervals subsequent thereto, the same operations as in intervals t1 to t6 are repeated.

On the other hand, the carriage 38 starts the movement thereof from the standby position and reciprocates over the platen 42. Specifically, according to the speed characteristic (see the dashed line 62) of the carriage 38 shown in FIG. 7, the movement in one direction and the movement in the opposite direction are repeated. Specifically, the carriage 38 is decelerated from interval t2 to interval t3 from the state where it is driven at a constant moving speed in one direction in interval t1, and then is stopped at the end of interval t3. The carriage is accelerated in the opposite direction in interval t4 and moves in the opposite direction from interval t4 to interval t5. The carriage 38 is driven in the opposite direction at a constant moving speed in interval t6. The carriage is decelerated again from interval t7 to interval t8 and is stopped at the end of interval t8. Then, the carriage is accelerated in the one direction in interval t9 and moves in the opposite direction from interval t9 to interval t10. The carriage 38 is driven in the one direction at a constant moving speed in interval t11. Thereafter, these operations are repeated, whereby the carriage 38 reciprocates over the platen 42.

In this exemplary embodiment, as indicated by the dashed line 61 and the dashed line 62 in FIG. 7, when the moving speed of the carriage 38 is lowered, or when it is stopped, the conveyance roller 87 is driven at a constant angular speed. When the angular speed of the conveyance roller 87 is lowered, or when it is stopped, the carriage 38 is driven at a constant angular speed. That is, the conveyance roller 87 and the carriage 38 are substantially alternately driven.

Differential Transmission Mechanism 110

The printer unit 2 includes the differential transmission mechanism 110, which is an example of a driving force transmission device for transmitting the rotational driving force of the first motor 71 and the second motor 72 to the conveyance roller 87 and the carriage 38. As shown in FIG. 4, the differential transmission mechanism 110 includes a differential gear 111A, which is an example of first differential unit, a differential gear 111B, which is an example of the second differential unit, a first transmission section 130, and a second transmission section 135.

As shown in FIG. 5, the differential gear 111A includes an input shaft 114A and an input shaft 115A. The input shaft 114A and the input shaft 115A are disposed coaxially. The differential gear 111A includes one output shaft 117A. The output shaft 117A extends in the direction perpendicular to the input shafts 114A and 115A.

The differential gear 111A includes two pinion gears 119A and 120A opposed to each other. The pinion gears 119A and 120A are bevel gears, respectively. The pinion gears 119A and 120A have the same number of teeth with the same pitch. The pinion gear 119A is integrally connected to the input shaft 114A. The pinion gear 120A is integrally connected to the input shaft 115A.

A ring gear 121A is provided on the input shaft 114A. The ring gear 121A is provided so that the rotation shaft thereof is matched with that of the pinion gear 119A. In this exemplary embodiment, the ring gear 121A is rotatably supported by the input shaft 114A. The ring gear 121A is a bevel gear. A pinion gear 122A is provided to engage with the ring gear 121A. The pinion gear 122A is a bevel gear and increases the number of rotations of the ring gear 121A twice. That is, the angular speed transmission ratio (gear ratio) from the ring gear 121A to the pinion gear 122A is set to "2." The pinion gear 122A is integrally connected to the output shaft 117A. In this exemplary embodiment, the pinion gear 122A increases the number of rotations of the ring gear 121A twice, but the ring gear 121A and the pinion gear 122A may have the same number of teeth. In brief, the number of teeth or the pitch of the ring gear 121A and the pinion gear 122A can be determined depending on the angular speed required as the rotation output of the output shaft 117A.

In the following description, in a case where rotation transmits from an input gear which inputs rotation to a gear train to an output gear which outputs rotation from the gear train, if the rotation transmits via an odd number of gears from the input gear to the output gear, it is defined that the output gear rotates in the same direction as the input gear and the angular speed transmission ratio is represented as a positive value. Similarly, if the rotation transmits via an even number of gears from the input gear to the output gear or the rotation transmits directly (the number of intervening gear is zero) while the input gear meshes with the output gear, it is defined that the output gear rotates in the opposite direction to the input gear and the angular speed transmission ratio is represented as a negative value.

Arms 123A are attached to one surface of the ring gear 121A. A shaft 124A extending in the direction perpendicular to the input shafts 114A and 115A is fixed to the arms 123A. The arms 123A, the shaft 124A and the ring gear 121A rotate integrally about the rotation axis of the ring gear 121A.

Two pinion gears 125A and 126A are rotatably supported by the shaft 124A. The pinion gear 125A engages with the pinion gears 119A and 120A at one end of the shaft 124A. The pinion gear 126A engages with the pinion gears 119A and 120A at the other end of the shaft 124A. From the point of mechanical view, it is sufficient that one of the pinion gear 125A and the pinion gear 126A is provided, but two pinion gears 125A and 126A engage with the pinion gears 119A and 120A in order to secure the balance.

It is noted that the angular speed transmission ratios between the pinion gears 119A and 120A, and the pinion gear 125A are necessary to correspond to the angular speed transmission ratios between the pinion gears 119A and 120A, and the pinion gear 126A. However, such angular speed transmissions are not necessary to be 1 since the angular speed transmission ratio does not affect the entire angular speed transmission ratio of the differential gear 111.

If the pinion gear 125 is rotated while the shaft 124A is fixed, it is obvious that the input shaft 114A and the input shaft 115A rotate at the same angular speed but in the opposite direction to each other since the pinion gear 119A and the pinion gear 120A have the same number of teeth with the same pitch. That is, the pinion gear 119A and the pinion gear 120A rotate at the same angular speed but in the opposite direction to each other at any time with respect to the shaft 124A and the arms 123A.

Then, it is described a case assuming that the input shaft 114A rotates at an angular speed of $V_1$ and the input shaft 115A rotates at an angular speed of $V_2$ in the same direction as the input shaft 114A. If the differential gear 111 is observed by a observer who rotates at an angular speed of $(V_1+V_2)/2$ in the same direction as the input shaft 114A about the input shaft 114A, the input shaft 114A rotates at an angular speed of $V_1-(V_1+V_2)/2=(V_1-V_2)/2$ relative to the observer and the input shaft 115A rotates at an angular speed of $V_2-(V_1+V_2)/2=-(V_1-V_2)/2$ relative to the observer. That is, the input shaft 114A and the input shaft 115A rotate at the same angular speed but opposite direction to each other relative to the observer. Therefore, it is found that the observer rotates together with the shaft 124A and the arms 123A. Since the above relationship is satisfied at any time, the shaft 124A and the arms 123A rotate at an angular speed of $(V_1+V_2)/2$ when the input shaft 114A rotates at an angular speed of $V_1$ and the input shaft 115A rotates at the angular speed of $V_2$ in the same direction as the input shaft 114A. That is, the angular speed of the ring gear 121A corresponds to a sum of ½ of the angular speed of the pinion gear 119A and the ½ of the angular speed of the pinion gear 120A.

From the above description, by considering the angular speed of the pinion gear 121A from each of the angular speeds input from the input shafts 114A and 115A, it can be said that the angular speed transmission ratio from the pinion gear 119A to the ring gear 121A is "½" and the angular speed transmission ratio from the pinion gear 120A to the ring gear 121A is "½". As described above, since the angular speed transmission ratio from the ring gear 121A to the pinion gear 122A is 2, the angular speed transmission ratio from the pin ion gear 119A to the pinion gear 122A is "1", which may correspond to a2, and the angular speed transmission ratio from the pinion gear 120A to the pinion gear 122A is "1", which may correspond to b2.

Accordingly, in the differential gear 111A having the above-described configuration, when the input shaft 114A and the input shaft 115A rotate at specific angular speeds, the output shaft 117A rotates at an angular speed proportional to a value obtained by adding the angular speed of the input shaft 114A to the angular speed of the input shaft 115A. Specifically, since the pinion gear 119A, the pinion gear 120A, the ring gear 121A, and the pinion gear 122A are configured as described above, the output shaft 117A rotates at the angular speed of $(V_1+V_2)$ when the input shaft 114A rotates at the angular speed of $V_1$ and the input shaft 115A rotates at the angular speed of $V_2$ in the same direction as the input shaft 114A.

As shown in FIG. 4, the differential gear 111B includes an input shaft 114B, an input shaft 115B, and one output shaft 117B. The differential gear 111B has the same configuration as the differential gear 111A and includes pinion gears 119B 120B having the same shape as the pinion gears 119A and 120A, an arm 123B having the same shape as the arm 123A, a shaft 124B having the same shape as the shaft 124A, and pinion gears 125B and 126B having the same shape as the pinion gears 125A and 126A. The differential gear further includes a ring gear 121B having the same shape as the ring gear 121A and a pinion gear 122B having the same shape as the pinion gear 122A. Accordingly, the input and output characteristic of the differential gear 111B is equal to the input and output characteristic of the differential gear 111A. That is, the angular speed transmission ratio from the pinion gear 119B to the pinion gear 122B is "1", which may correspond to c2, and the angular speed transmission ratio from the pinion gear 120B to the pinion gear 122B is "1", which may correspond to d2. Since the elements of the differential gear 111B are similar to the elements of the differential gear 111A, the detailed description thereof is omitted herein.

In this exemplary embodiment, as shown in FIG. 4, the differential gear 111A and the differential gear 111B are horizontally arranged in parallel. The carriage 38 is connected to the output shaft 117A of the differential gear 111A through the belt driving mechanism 46 (of which the transmission ratio p equals 1) (see FIG. 6). On the other hand, the conveyance roller 87 is connected to the output shaft 117B of the differential gear 111B through the gear driving mechanism 85 (of which the transmission ratio q equals 1) (see FIG. 6).

First Transmission Section 130

A first transmission section 130 is provided in the input shaft 114A of the differential gear 111A and the input shaft 114B of the differential gear 111B. The first transmission section 130 includes three gears 131, 132, and 133. The gears 131, 132, and 133 are substantially disk-like spur gears. The gear 131 is integrally connected to the input shaft 114A. The gear 132 is integrally connected to the input shaft 114B. The gear 133 engages with both the gear 131 and the gear 132. A rotation shaft 74 of the first motor 71 is integrally connected to the gear 133. That is, the input shaft 114A of the differential gear 111A is connected to the rotation shaft 74 of the first motor 71 through the gear 131 and the gear 133 of the first transmission section 130. Accordingly, the rotational driving force of the first motor 71 is transmitted to the input shaft 114A sequentially through the gear 133 and the gear 131. The transmission mechanism including the gear 131, the gear 133, and the pinion gear 122A of the differential gear 111A may correspond to a first transmission mechanism.

The input shaft 114B of the differential gear 111B is connected to the rotation shaft 74 of the first motor 71 through the gear 132 and the gear 133 of the first transmission section 130. Accordingly, the rotational driving force of the first motor 71 is transmitted to the input shaft 114B sequentially through the gear 133 and the gear 132. The transmission mechanism including the gear 132, the gear 133, and the pinion gear 122B of the differential gear 111B may correspond to a third transmission mechanism.

Since the rotation shaft 74 of the first motor 71 is connected to the input shafts 114A and 114B through the first transmission section 130, the rotational driving force in the direction opposite to the rotation direction of the first motor 71 is transmitted to the input shafts 114A and 114B. Accordingly, for example, as shown in FIG. 4, when the first motor 71 rotates in the direction of the arrow 53, the input shafts 114A and 114B rotate in the direction of the arrow 54. It is noted that the input shafts 114A and 114B are connected to the rotation shaft 74 directly with the gear 133 and gear 131 or gear 132 in the above-described exemplary embodiment. However, the input shafts 114A and 114B may be connected to the rotation shaft 74 through a belt wound around the rotation shaft input shaft 114A or the input shaft 114B.

In this exemplary embodiment, three gears 131, 132, and 133 of the first transmission section 130 have the same configuration and have the same number of teeth with the same pitch. Accordingly, the angular speed transmission ratio (gear ratio) from the rotation shaft 74 to the input shaft 114A through the gear 133 and the gear 131, that is, the value obtained by dividing the angular speed of the input shaft 114A by the angular speed (angular speed of the first motor 71) of the rotation shaft 74, is "1." Accordingly, when the first motor 71 is rotated, the input shaft 114A rotates at the same angular speed as the first motor 71. However, since two gears (the gear 133 and the gear 131) are interposed between the input shaft 114A and the rotation shaft 74, the input shaft 114A rotates in the direction opposite to the rotation direction of the first motor 71. In the following description, for the purpose of explanation convenience, a negative sign "−" indicating that the rotation direction of the first motor 71 is different from the rotation direction of the input shaft 114A is attached to the angular speed transmission ratio. When the rotation directions are same with each other, the sign is not attached thereto. Accordingly, in the following description, the angular speed transmission ratio from the rotation shaft 74 to the input shaft 114A through the gear 133 and the gear 131 is represented by "−1." This angular speed transmission ratio may correspond to a transmission ratio a1.

The angular speed transmission ratio (gear ratio) from the rotation shaft 74 to the input shaft 114B through the gear 133 and the gear 132, that is, the value obtained by dividing the angular speed of the input shaft 114B by the angular speed (the rotation of the first motor 71) of the rotation shaft 74, is "1." Accordingly, when the first motor 71 is rotated, the input shaft 114B rotates at the same angular speed as the first motor 71. However, since two gears (the gear 133 and the gear 132) are interposed between the rotation shaft 74 and the input shaft 114B, the input shaft 114B rotates in the direction opposite to the rotation direction of the first motor 71. Accordingly, in the following description, the angular speed transmission ratio from the rotation shaft 74 to the input shaft 114B through the gear 133 and the gear 132 is represented by "−1." This angular speed transmission ratio may correspond to a transmission ratio c1.

Second Transmission Section 135

A second transmission section 135 is provided in the input shaft 115A of the differential gear 111A and the input shaft 115B of the differential gear 111B. The second transmission section 135 includes three gears 136, 137, and 138. The gears are substantially disk-like spur gears. The gear 136 is integrally connected to the input shaft 115A. The gear 137 is integrally connected to the input shaft 115B. The gear 137 engages with the gear 136. The gear 138 engages with the gear 136. A rotation shaft 75 of the second motor 72 is integrally connected to the gear 138. That is, the input shaft 115A is connected to the rotation shaft 75 of the second motor 72 through the gear 136 and the gear 138 of the second transmission section 135. Accordingly, the rotational driving force of the second motor 72 is transmitted to the input shaft 115A sequentially through the gear 138 and the gear 136. The transmission mechanism including the gear 138, the gear 136, and the pinion gear 122A of the differential gear 111A may correspond to a second transmission mechanism.

The input shaft 115B of the differential gear 111B is connected to the rotation shaft 75 of the second motor 72 through the gears 137, 136, and 138 of the second transmission section 135. Accordingly, the rotational driving force of the second motor 72 is transmitted to the input shaft 115B sequentially through the gears 138, 136, and 137. The transmission mechanism including the gears 136, 137, and 138 and the pinion gear 122B of the differential gear 111B may correspond to a fourth transmission mechanism.

In this way, since the rotation shaft 75 of the second motor 72 is connected to the input shafts 115A and 115B through the second transmission section 135, the rotational driving force in the direction opposite to the rotation direction of the second motor 72 is transmitted to the input shaft 115A and the rotational driving force in the direction same as the rotation direction of the second motor 72 is transmitted to the input shaft 115B. Accordingly, for example, as shown in FIG. 4, when the second motor 72 is rotated in the direction of the arrow 56, the input shaft 115A rotates in the direction of the arrow 55 (the direction same as the rotation direction of the input shafts 114A and 114B) opposite to the direction of the arrow 56. On the other hand, the input shaft 115B rotates in the direction of the arrow 55 (the direction opposite to the rotation direction of the input shaft 114A and 114B) same as the rotation direction of the second motor 72.

In this exemplary embodiment, three gears 136, 137, and 138 of the second transmission section 135 have the same configuration and have the same number of teeth with the same pitch. Accordingly, the angular speed transmission ratio (gear ratio) from the rotation shaft 75 to the input shaft 115A through the gear 138 and the gear 136, that is, the value obtained by dividing the angular speed of the input shaft 115A by the angular speed (angular speed of the second motor 72) of the rotation shaft 75, is "1." Accordingly, when the second motor 72 is rotationally driven, the input shaft 115A rotates at the same angular speed as the second motor 72. However, since two gears (the gear 138 and the gear 136) are interposed between the input shaft 115A and the rotation shaft 75, the input shaft 115A rotates in the direction opposite to the rotation direction of the second motor 72. In the following description, for the purpose of explanation convenience, a negative sign "−" indicating that the rotation direction of the second motor 72 is different from the rotation direction of the input shaft 115A is attached to the angular speed transmission ratio. When the rotation directions are same with each other, the sign is not attached thereto. Accordingly, in the following description, the angular speed transmission ratio from the rotation shaft 75 to the input shaft 115A through the gear 138 and the gear 136 is represented by "−1." This angular speed transmission ratio may correspond to a transmission ratio b1.

The angular speed transmission ratio (gear ratio) from the rotation shaft 75 to the input shaft 115B sequentially through the gear 138, the gear 136, and the gear 137, that is, the value obtained by dividing the angular speed of the input shaft 115B by the angular speed (the rotation of the second motor 72) of the rotation shaft 75, is "1." Accordingly, when the second motor 72 is rotated, the input shaft 115B rotates at the same angular speed as the second motor 72. It is noted that since three gears (the gears 136, 137, and 138) are interposed between the rotation shaft 75 and the input shaft 115B, the input shaft 115B rotates in the direction same as the rotation direction of the second motor 72. Accordingly, in the following description, the angular speed transmission ratio from the rotation shaft 75 to the input shaft 115B sequentially through the gear 138, the gear 136, and the gear 137 is represented by "1." This angular speed transmission ratio may correspond to a transmission ratio d1.

In this exemplary embodiment, as described above, the angular speed transmission ratio from the ring gear 121A to the pinion gear 122A is "2" and the angular speed transmission ratio from the rotation shaft 74 to the input shaft 114A is "−1". Accordingly, when the angular speed transmission ratio of the transmission mechanism from the rotation shaft 74 to the output shaft 117A through the input shaft 114A and the inside of the differential gear 111A (the pinion gear 122A and the like) is "a", the angular speed transmission ratio "a" becomes "−1". In addition, the angular speed transmission ratio from the rotation shaft 75 to the input shaft 115A is "−1." Accordingly, when the angular speed transmission ratio of the transmission mechanism from the rotation shaft 75 to the output shaft 117A through the input shaft 115A and the inside (the pinion gear 122A and the like) of the differential gear 111A is "b", the angular speed transmission ratio "b" becomes "−1."

The angular speed transmission ratio from the ring gear 121B to the pinion gear 122B is "2" and the angular speed transmission ratio from the rotation shaft 74 to the input shaft 114B is "−1." Accordingly, when the angular speed transmission ratio of the transmission mechanism from the rotation shaft 74 to the output shaft 117B through the input shaft 114B and the inside of the differential gear 111B (the pinion gear 122B and the like) is "c", the angular speed transmission ratio "c" becomes "−1". In addition, the angular speed transmission ratio from the rotation shaft 75 to the input shaft 115B is "1." Accordingly, when the angular speed transmission ratio of the transmission mechanism from the rotation shaft 75 to the output shaft 117B through the input shaft 115B and the inside (the pinion gear 122B and the like) of the differential gear 111B is "d", the angular speed transmission ratio "d" becomes "1."

In the differential transmission mechanism 110 having the above-described configuration, as shown in FIG. 4, when the rotation shaft 74 of the first motor 71 rotates at the angular speed X in the direction of the arrow 53 and the rotation shaft 75 of the second motor 72 rotates at the angular speed Y in the direction of the arrow 56, the angular speed u of the output shaft 117A and the angular speed v of the output shaft 117B can be expressed as follows by Expression 1 using the angular speed transmission ratios a, b, c and d. Symbol A in Expression 1 represents a matrix obtained by expressing the transmission ratios a, b, c and d in a 2×2 matrix. The matrix A satisfies the relation, det A=ad−bc=−2, that is, det A≠0. Accordingly, the matrix A has an inverse matrix $A^{-1}$.

Expression 1

$$\begin{pmatrix} u \\ v \end{pmatrix} = \begin{pmatrix} aX + bY \\ cX + dY \end{pmatrix} = \begin{pmatrix} a & b \\ c & d \end{pmatrix}\begin{pmatrix} X \\ Y \end{pmatrix} = \begin{pmatrix} -1 & -1 \\ -1 & 1 \end{pmatrix}\begin{pmatrix} X \\ Y \end{pmatrix} = A\begin{pmatrix} X \\ Y \end{pmatrix}$$

Here, det A=ad−bc=−2≠0

Motor Driver 100

The printer unit 2 includes a motor driver (abbreviated as "driver") 100 (see FIG. 6), which is an example of a controller. The driver 100 independently controls the angular speeds of the first motor 71 and the second motor 72. The driver 100 includes a target speed generator 103, a driving quantity converter 105, a driving quantity converter 106, a calculator 102, and a driving current converter 104.

The calculator 102 is configured by, for example, a micro computer including a central processing unit (CPU), a read only memory (ROM), a random access memory (RAM), and the like.

The ROM stores a program used for driving control of the first motor 71 and the second motor 72 or a program used for analyzing the detection signals output from the optical sensors 35 and 83.

The RAM is used as a memory area for temporarily storing various data used for the CPU to execute the programs or a work area for performing the calculation process. For example, the detection signals output from the optical sensors 35 and 83 or the position information acquired from the detection signals are stored in the RAM.

The target speed generator 103 generates a target moving speed U of the carriage 38 and a target angular speed V of the conveyance roller 87. The target speeds U and V are generated based on specific target speed characteristics (target speed profiles) where the horizontal axis represents time and the vertical axis represents speed. The target speed characteristics are stored in an inner memory (not shown) in the target speed generator 103. In this exemplary embodiment, when the target angular speed of the first motor 71 at the time of driving the carriage 38 and the conveyance roller 87 at the target speeds U and V, respectively, is X and the target angular speed of the second motor 72 is Y, the target speed generator 103 generates the target moving speed U (=aX+bY) expressed as a linear equation of the target angular speed X and the target angular speed Y using the angular speed transmission ratios a and b and the target angular speed V (=cX+dY) expressed as the linear equation of the target angular speed X and the target angular speed Y using the angular speed transmission ratios c and d. The target speeds U and V are expressed by Expression 2 using the matrix A of Expression 1. The target speeds U and V generated by the target speed generator 103 are output to the driving quantity converter 105.

Expression 2

$$\begin{pmatrix} U \\ V \end{pmatrix} = \begin{pmatrix} aX + bY \\ cX + dY \end{pmatrix} = \begin{pmatrix} a & b \\ c & d \end{pmatrix}\begin{pmatrix} X \\ Y \end{pmatrix} = \begin{pmatrix} -1 & -1 \\ -1 & 1 \end{pmatrix}\begin{pmatrix} X \\ Y \end{pmatrix} = A\begin{pmatrix} X \\ Y \end{pmatrix}$$

The target moving speed U of the carriage 38 and the target angular speed V of the conveyance roller 87 generated by the target speed generator 103 are input to the driving quantity converter 105. The driving quantity converter 105 performs a process of multiplying the inverse matrix $A^{-1}$ of matrix A by a set (U,V) of the input target speeds, that is, a vector (U,V) having the input target speeds as elements. Accordingly, the target speeds U and V are converted to the angular speeds X and Y. The converted angular speed X and Y are output to the calculator 102. This conversion process is expressed by Expression 3 using the inverse matrix $A^{-1}$.

Expression 3

$$\begin{pmatrix} X \\ Y \end{pmatrix} = A^{-1}\begin{pmatrix} U \\ V \end{pmatrix}$$

The optical sensor 35 and the optical sensor 83 are connected to the driving quantity converter 106. The detection signals output from the optical sensor 35 and the optical sensor 83 are input to the driving quantity converter 106. The movement position of the carriage 38 is acquired based on the detection signal from the optical sensor 35 by the driving quantity converter 106. Specifically, the number of pulses included in the detection signal is counted and the distance corresponding to the counted value is calculated as the distance (movement position) from a predetermined reference position (for example, the standby position). Accordingly, the position information of the carriage 38 with respect to the reference position is acquired. The actual moving speed U' of the carriage 38 is calculated from the position information of the carriage 38 and the counted time. The rotation position of the conveyance roller 87 is acquired on the basis of the detection signal from the optical sensor 83 by the driving quantity converter 106. Specifically, the number of pulses included in the detection signal is counted and the rotation angle corresponding to the counted value is calculated as the rotation position information. The actual angular speed V' of the conveyance roller 87 is calculated from the rotation angle of the conveyance roller 87 and the counted time. The driving quantity converter 106 performs a process of multiplying the inverse matrix $A^{-1}$ of matrix A by a set (U', V') of the calculated speeds, that is, a vector (U',V') having the calculated speeds as elements. Accordingly, the speeds U' and V' are converted into the angular speeds X' and Y', respectively. The converted angular speeds X' and Y' are output to the calculator 102.

The calculator 102 generates signals Sx and Sy for determining the driving current output to the first motor 71 and the second motor 72 from the driving current converter 104. This process is embodied by performing a calculation process or a data process in accordance with the program stored in the ROM. In the related-art control system, the target speeds U and V and the speeds U' and V' are directly input to the calculator 102 and the driving current of the motors is determined based on the difference therebetween. However, in this exemplary embodiment, the calculator 102 generates the signal $S_X$ corresponding to the difference between the input angular speed X and the angular speed X' and the signal $S_Y$ corresponding to the difference between the angular speed Y and the angular speed Y'. The signal $S_X$ includes information indicating the driving current value necessary for allowing the first motor 71 to rotate at the angular speed X and the signal $S_Y$ includes information indicating the driving current value necessary for allowing the second motor 72 to rotate at the angular speed Y. The signals $S_X$ and $S_Y$ are output to the driving current converter 104.

In this embodiment, the signals $S_X$ and $S_Y$ are generated by performing the calculation process or the data process in accordance with the program stored in the ROM. However, for example, the signals may be generated by the use of a calculation process performed by the CPU or a process performed by the driving quantity converter 105 and 106 in an ASIC in which electronic components such as capacitors and transistors form logical circuits.

The driving current converter 104 is connected to the calculator 102. The signals $S_X$ and $S_Y$ generated by the calculator 102 are input to the driving current converter 104. The power of a predetermined voltage (for example, DC 24V) is applied to the driving current converter 104 from a power source (not shown). The driving current converter 104 generates the driving current $I_X$ corresponding to the signal $S_X$ and the driving current $I_Y$ corresponding to the signal $S_Y$. As shown in FIG. 6, the driving current $I_X$ is supplied to the first motor 71 and the driving current $I_Y$ is supplied to the second motor 72.

The first motor 71 supplied with the driving current $I_X$ ideally rotates at the angular speed X corresponding to the driving current $I_X$. Similarly, the second motor 72 supplied with the driving current $I_Y$ ideally rotates at the angular speed Y corresponding to the driving current $I_Y$. However, since the frictional resistance is not actually constant or the eccentricity of the motor shaft actually influences, the actual angular speeds are not equal to the target angular speeds. The first motor 71 rotates at the angular speed X' not equal to the angular speed X and the second motor 72 rotates at the angular speed Y' not equal to the angular speed Y.

When the first motor 71 rotates at the angular speed X' and the second motor 72 rotates at the angular speed Y', the output shaft 117A of the differential gear 111A rotates at the angular speed u'=aX'+bY' from Expression 1. That is, the angular speed of the output shaft 117A is a sum of a times the angular speed X' of the first motor 72 and b times the angular speed Y' of the second motor 72. In this exemplary embodiment, since the transmission ratio a is "−1" and the transmission ratio b is "−1", the output shaft 117A rotates at the angular speed u'=−X'−Y'. At this time, the carriage 38 moves at the moving speed U'=p(aX'+bY') obtained by multiplying the transmission ratio p of the belt driving mechanism 46 by the angular speed u'. In this exemplary embodiment, since the transmission ratio p is "1", the carriage 38 moves at the moving speed U'=−X'−Y'.

On the other hand, when the first motor 71 rotates at the angular speed X' and the second motor 72 rotates at the angular speed Y', the output shaft 117B of the differential gear 111B rotates at the angular speed v'=cX'+dY' from Expression 1. That is, the angular speed of the output shaft 117B is a sum of c times the angular speed X' of the first motor 72 and d times the angular speed Y' of the second motor 72. In this exemplary embodiment, since the transmission ratio c is "−1" and the transmission ratio d is "1", the output shaft 117B rotates at the angular speed v'=−X'+Y'. At this time, the conveyance roller 87 rotates at the angular speed V'=q(cX'+dY') obtained by multiplying the transmission ratio q of the gear driving mechanism 85 by the angular speed v'. In this exemplary embodiment, since the transmission ratio q is "1", the conveyance roller 87 rotates at the angular speed V'=−X'+Y'.

In this exemplary embodiment, since the first motor 71 and the second motor 72 are controlled in driving by the driving current $I_X$ and $I_Y$, the moving speed of the carriage 38 is changed with the time t as indicated by the dashed line 62 of FIG. 7 and the angular speed of the conveyance roller 87 is changed with the time t as indicated by the dashed line 61 of FIG. 7. However, since the frictional resistance is not actually constant or the eccentricity of the motor shaft actually influences, the carriage 38 moves at the moving speed U' and the conveyance roller 87 rotates at the angular speed V'. However, the actual moving speeds of the carriage 38 and the conveyance roller 87 are detected by the optical sensors 35 and 83, respectively and the detection results are fed back to the driver 100. Accordingly, the carriage 38 and the conveyance roller 87 are always maintained in the speeds close to the ideal speeds.

Change in Angular Speed X' and Angular Speed Y'

By connecting the first motor 71 and the second motor 72 to the differential transmission mechanism 110 having the above-described configuration and controlling the first motor 71 and the second motor 72 in the feedback manner by the use of the driver 100, the angular speed X' of the first motor 71 is changed with the time t as indicated by the solid line 63 of FIG. 7 and the angular speed Y' of the second motor 72 is changed with the time t as indicated by the dotted line 64 of FIG. 7. That is, by controlling the first motor 71 and the second motor 72 by the use of the driving current $I_X$ and $I_Y$, the angular speed X' and the angular speed Y' are changed as indicated by the solid line 63 and the dotted line 64 of FIG. 7. Accordingly, the carriage 38 and the conveyance roller 87 can be driven as indicated by the dashed lines 61 and 62 of FIG. 7. The change of the angular speed X' and the angular speed Y' will be described in detail now with reference to FIG. 7. In the following description, for the purpose of explanation convenience, it is assumed that the first motor 71 and the second motor 72 have the same capacity and the same size. The above-described specific numerical values are substituted as the transmission ratios a, b, c and d, the transmission ratio p and q and the gear ratio of the pinion gears 122A and 122B.

Interval t1 is a constant-speed driving area of the carriage 38 and also is a pause area of the conveyance roller 87. In interval t1, the first motor 71 is rotated by the driving current $I_X$ and the second motor 72 is rotated by the driving current $I_Y$, whereby they rotate in the same rotation direction at the same angular speed $X'_{t1}$ ($=Y'_{t1}$). At this time, in the differential gear 111A, since the input shaft 114A and the input shaft 115A rotate in the same rotation direction at the same angular speed, the output shaft 117A rotates at the angular speed $(-X'_{t1}-Y'_{t1})=-2X'_{t1}$ obtained by adding the angular speed of the input shaft 114A and the angular speed of the input shaft 115A. On the other hand, in the differential gear 111B, since the input shaft 114B and the input shaft 115B rotate in the opposite directions at the same angular speed, the output shaft 117B dose not rotate $(-X'_{t1}-(-Y'_{t1})=0)$. Accordingly, the carriage 38 moves at the constant moving speed $(-2X'_{t1})$ and the conveyance roller 87 maintains the pause state.

Interval t2 is a decelerated driving area of the carriage 38 and also an accelerated driving area of the conveyance roller 87. In interval t2, the driving current $I_X$ has the same magnitude as that in interval t1. Since the driving current $I_X$ is supplied to the first motor 71, the first motor 71 rotates at the same angular speed $X'_{t2}$ ($=X'_{t1}$) as that in interval t1. In interval t2, the driving current $I_Y$ is lowered and the angular speed $Y'_{t2}$ of the second motor 72 is slowly reduced. At this time, in the differential gear 111A, since the input shaft 114A and the input shaft 115A rotate in the same rotation direction but the angular speed of the input shaft 115A is reduced due to the deceleration of the second motor 72, the angular speed of the output shat 117A is slowly reduced. Accordingly, the moving speed of the carriage 38 is slowly decelerated. When the carriage 38 is decelerated, the kinetic energy of the carriage 38 moving at a specific moving speed acts on the output shaft 117A as an external force causing the output shaft 117A to rotate through the belt driving mechanism 46. At this time, the external force causing the output shaft 117A to rotate is transmitted to the input shafts 114A and 115A through the differential gear 111A, is further transmitted to the output shaft 117B of the differential gear 111B and the gear driving mechanism 85 from the first transmission section 130 and the second transmission section 135, and is used as the driving force accelerating the conveyance roller 87. That is, when the carriage 38 is decelerated, the kinetic energy thereof is not uselessly consumed and is used as the energy accelerating the conveyance roller 87.

On the other hand, in the differential gear 111B, since the angular speed of the input shaft 115B is reduced with the deceleration of the second motor 72, the reduced amount acts on the output shaft 117B as the force causing the output shaft 117B to rotate. As described above, the kinetic energy of the carriage 38 acts on the output shaft 117B as the force causing the output shaft 117B. Accordingly, the output shaft 117B starts its rotation and the rotation of the conveyance roller 87 is started.

Intervals t3 and t4 are areas where the carriage 38 is decelerated, paused, and accelerated and also a constant-speed driving area of the conveyance roller 87. In interval t3, since the driving current $I_X$ is reduced, the angular speed $X'_{t3}$ of the first motor 71 is slowly reduced. The reduction of the angular speed $X'_{t3}$ of the first motor 71 is continued in the middle of interval t4 and then the first motor 71 is paused. In interval t4, the reverse current $I_X$ (<0) is supplied to the first motor 71 and the first motor 71 is accelerated in the reverse rotation direction. On the other hand, the driving current $I_Y$ is further reduced in interval t3 and the second motor 72 is paused. Thereafter, the reverse current $I_Y$ (<0) is supplied to the second motor 72 and the reverse current $I_Y$ (<0) is supplied to the second motor 72 from interval t3 to interval t4. Accordingly, the second motor 72 is accelerated in the reverse rotation direction.

In this exemplary embodiment, in interval t3, the acceleration of the conveyance roller 87 is ended and driven at a constant angular speed. On the other hand, the carriage 38 is slowly decelerated and the movement direction thereof is inverted in interval t4. In intervals t3 and t4, while the conveyance roller 87 is being driven at a constant angular speed, the reverse current $I_X$ (<0) and $I_Y$ (<0) supplied to the motors 71 and 72 are used to reduce the angular speed of the output shaft 117A and to invert the rotation direction of the output shaft 117A. That is, the reverse current is used to invert the movement direction of the carriage 38. In intervals t3 and t4, the torques of the motors 71 and 72 are transmitted to the carriage 38 from the output shaft 117A.

Interval t5 is an accelerated driving area of the carriage 38 in the reverse direction and also a decelerated driving area of the conveyance roller 87. In interval t5, the reverse current $I_X$ (<0) is reduced more (the absolute value of Ix is increased) and the angular speed $X'_{t5}$ of the first motor 71 is slowly increased. On the other hand, the reverse current $I_Y$ (<0) is constant and the second motor 72 is rotationally driven at a constant angular speed $Y'_{t5}$. At this time, in the differential gear 111B, the input shaft 114B and the input shaft 115B rotate in the opposite directions, but the difference in angular speed between the shafts is slowly reduced. Accordingly, the output shaft 117B is slowly reduced in angular speed. That is, the conveyance roller 87 is slowly decelerated. When the conveyance roller 87 is decelerated, the kinetic energy of the conveyance roller 87 rotating at a specific angular speed acts on the output shaft 117B as the external force causing the output shaft 117B to rotate through the gear driving mechanism 85. At this time, the external force causing the output shaft 117B to rotate is transmitted to the input shafts 114B and 115B through the differential gear 111B, and is further transmitted to the output shaft 117A of the differential gear 111A and the belt driving mechanism 46 from the first transmission section 130 and the second transmission section 135, and is used as the driving force accelerating the carriage 38.

On the other hand, in the differential gear 111A, since the input shaft 114A and the input shaft 115A rotate in the same rotation direction, but the rotation of the input shaft 115A is changed from the accelerated driving to the constant-speed driving, the angular speed of the output shaft 117A is increased by the first motor 71. As described above, since the kinetic energy of the conveyance roller 87 acts on the output shaft 117A as the external force causing the output shaft 117A to rotate, the rotation of the output shaft 117A is accelerated by the external force. That is, the conveyance roller 87 is accelerated by the first motor 71 and the external force.

Interval t6 is an area where the acceleration of the carriage 38 in the reverse direction and the carriage is driven at a constant moving speed and also an area where the deceleration of the conveyance roller 87 is ended and is paused. In interval t6, the reverse current $I_X$ (<0) and $I_Y$ (<0) are constant and the motors 71 and 72 are rotationally driven in the reverse direction at a constant angular speed $X'_{t6}$ ($=Y'_{t6}$). At this time, in the differential gear 111A, since the input shaft 114A and the input shaft 115A rotate at the same angular speed in the same rotation direction, the output shaft 117A rotates at the angular speed $(-X'_{t6}-Y'_{t6})=-2X'_{t6}$ obtained by summing the angular speeds of the input shaft 114A and the input shaft 115A. On the other hand, in the differential gear 111B, since the input shaft 114B and the input shaft 115B rotate at the same angular speed in the reverse directions, the output shaft 117B does not rotate ($-X'_{t6}-(-Y'_{t6})=0$). Accordingly, the carriage 38 moves at a constant moving speed ($-2X'_{t6}$) in the reverse direction and the conveyance roller 87 keeps its paused state.

In interval t7 to interval t10, by controlling the motors 71 and 72 in the opposite order of the operations of interval t2 to interval t5, the decelerated driving, the pause, and the accelerated driving of the carriage 38 are performed and the accelerated driving, the constant-speed driving, and the decelerated driving of the conveyance roller 87 is performed. In interval t6, by controlling the motors 71 and 72 oppositely to the control of the motors in interval t1, the constant-speed driving of the carriage 38 and the pause of the conveyance roller 87 are performed.

Operational Advantages

As described above, by connecting the first motor 71 and the second motor 72 to the differential transmission mechanism 110 and controlling the first motor 71 and the second motor 72 by the use of the driver 100 in the feedback control manner, the rotational driving force of two motors 71 and 72 can be used to cause the carriage 38 to move, for example, even while the conveyance roller 87 is paused. While the conveyance roller 87 is paused, the torques of the motors 71 and 72 can be applied to the carriage 38. Accordingly, even when a motor having small capacity is used, it is possible to smoothly drive the carriage 38. That is, when the first motor 71 and the second motor 72 are driven in the state where the carriage 38 has a high load and the conveyance roller 87 has a low load, the driving force of the first motor 71 and the second motor 72 can be optimally distributed to the driven members of the carriage 38 and the conveyance roller 87.

During the driving control of the carriage 38 and the conveyance roller 87, the motors 71 and 72 always rotate at the relatively high speed even when one of the carriage 38 or the conveyance roller 87 is driven at a low speed. Accordingly, it is possible to obtain a relatively great torque at the time of low-speed driving of the carriage 38 or the conveyance roller 87. When one of the carriage 38 and the conveyance roller 87 is stopped, both the driving torques of the first motor 71 and the second motor 72 are applied to the driven members. Accordingly, the inventive concept of the present invention can be applied suitably at the time of start up requiring a great torque.

Like the related-art mechanism, when the transmission mechanism of the carriage 38 and the transmission mechanism of the conveyance roller 87 are completely independent of each other, the kinetic energy of the carriage 38 and the conveyance roller 87 is converted into heat and uselessly consumed at the time of decelerating the carriage 38 and the conveyance roller 87. However, in the differential transmission mechanism 110 of the above-described exemplary embodiment when the carriage 38 is decelerated, the kinetic energy is used as the driving force of the conveyance roller 87. On the contrary, when the conveyance roller 87 is decelerated, the kinetic energy thereof is used as the driving force of the carriage 38. Accordingly, the energy can be effectively used in the differential transmission mechanism 110. It is possible to reduce the power consumption at the time of deceleration.

While the present invention has been shown and described with reference to certain exemplary embodiments thereof, it will be understood by those skilled in the art that various changes in form and details may be made therein without departing from the spirit and scope of the invention as defined by the appended claims.

For example, in the above-described exemplary embodiment, the transmission ratio a in the differential transmission mechanism 110 is "−1", the transmission ratio b is "−1", the transmission ratio c is "−1", and the transmission ratio d is "1." in consideration of the symmetry that the conveyance roller 87 and the carriage 38 are alternately driven. However, the transmission ratios a, b, c and d are only design factors and when the transmission ratios a, b, c and d satisfy the relation of $ad-bc\neq 0$, the transmission ratios a, b, c and d can be properly changed to any value depending on the required operation or moving speed of the carriage 38 or the conveyance roller 87. In general, the transmission ratios a, b, c and d can be set so that the angular speed u of the output shaft 117A and the angular speed v of the output shaft 117B satisfy Expression 4.

$$\begin{pmatrix} u \\ v \end{pmatrix} = \begin{pmatrix} aX + bY \\ cX + dY \end{pmatrix} = \begin{pmatrix} a & b \\ c & d \end{pmatrix}\begin{pmatrix} X \\ Y \end{pmatrix} = A\begin{pmatrix} X \\ Y \end{pmatrix} \quad \text{Expression 4}$$

Here, $\det A = ad-bc\neq 0$

In the above-described exemplary embodiment, the position information of the carriage 38 is detected by the optical sensor 35, the position information of the conveyance roller 87 is detected by the optical sensor 83, and the detection results are fed back to the driver 100 to control the first motor 71 and the second motor 72. However, for example, as shown in a modified exemplary embodiment of FIG. 8, an optical sensor 107 and an optical sensor 108 which measure (acquire) the angular speeds of the first motor 71 and the second motor 72 may be provided to feed back the angular speed X' measured by the optical sensor 107 to the calculator 102 of the driver 100 and to feed back the angular speed Y' measured by the optical sensor 108. In this case, since the actual angular speeds of the first motor 71 and the second motor 72 are input directly to the calculator 102, the driving quantity converter 106 is not necessary. Since the process of the calculator 102 and the like is the same as described in the above-described exemplary embodiment, description thereof is omitted.

The above-described exemplary embodiment describes an example where the inventive concept of the present invention is applied to the first motor 71 and the second motor 72 used to drive the carriage 38 and the conveyance roller 87 in the printer unit 2. However, the inventive concept of the present invention can be applied to all the driving mechanisms in which the load of one of two driven members driven and controlled by the motors 71 and 72 increases and then the load of the other driven member decreases. Accordingly, for example, in a bipedal walking robot, when leg portions are driven by two motors, the inventive concept of the present invention can be applied to a bipedal walking mechanism in which one leg portion is driven in the forward direction and the other leg portion supports the weight of the robot.

The inventive concept of the present invention can be applied to mechanisms including at least two motors and at least two driven members and can also be applied to mechanisms for driving a multi-leg walking robot having three or more leg portions by the use of three or more motors and three or more differential gears. Here, in a differential driving mechanism having N input shafts to which the driving force of N (where N is an integer of 3 or more) motors is input and N output shafts, when a vector having the angular speeds of the output shafts as elements is a vector $U_N$ and a vector having the angular speeds of the motors as elements $X_N$, the vectors $U_N$ and $X_N$ can be expressed by Expression 5 using an N×N matrix A representing the transmission ratios between the rotation shafts of the motors and the output shafts. Here, the matrix A satisfies det A≠0.

$$\vec{U}_N = A\vec{X}_N \det A \neq 0 \qquad \text{Expression 5}$$

By configuring the differential driving mechanism to satisfy Expression 5, the same advantages as the above-described embodiment can be obtained in the mechanism having three or more input shafts and output shafts.

The present invention provides illustrative, non-limiting exemplary embodiments as follows:

(1) A driving force transmission device for transmitting driving force of a first motor and a second motor, angular speeds of which are controlled independently, to a first driven member and a second driven member. The first driving force transmission device includes a first differential unit and a second differential unit. The first differential unit includes a first input shaft connected to a first rotation shaft of the first motor, a second input shaft connected to a second rotation shaft of the second motor, and a first output shaft connected to the first driven member. The second differential unit includes a third input shaft connected to the first rotation shaft of the first motor, a fourth input shaft connected to the second rotation shaft of the second motor, and a second output shaft connected to the second driven member. In the driving force transmission device, when the first motor and the second motor are rotated, the angular speed of the first output shaft becomes a sum of a times the angular speed of the first motor and b times the angular speed of the second motor and the angular speed of the second output shaft becomes a sum of c times the angular speed of the first motor and d times the angular speed of the second motor. Here, a, b, c, and d satisfy a relation of ad−bc≠0.

According to the above-described driving force transmission device, it is possible to obtain two rotation outputs linearly independent of each other. In other words, the control of the angular speeds of the first output shaft and the second output shaft, that is, the control of the speeds of the first driven member and the second driven member, can be independently carried out. For example, like an ink-jet printing type image recording apparatus, in the case that a conveyance roller as the first driven member and a carriage as the second driven member are alternately driven, that is, in the case that the conveyance roller and the carriage are not driven concurrently, the conveyance has a low load or no load when the load of the carriage is the maximum. In this way, when the first motor and the second motor are driven in the state where one has a high load and the other has a low load, the above-described driving force transmission device can distribute the driving force (driving torque) of the first motor and the second motor as follows by the use of two rotation outputs of the first output shaft and the second output shaft linearly independent of each other. That is, regardless of the operating states of the first driven member and the second driven member, the driving force of the first motor and the second motor can be optimally distributed to the driven members, respectively, depending on the loads of the driven members. Accordingly, it is possible to efficiently use the driving force of the first motor and the second motor without wasting. As a result, it is possible to obtain a desired rotation output without any increase in size of the motors.

As described above, since the driving force of the first motor and the second motor is optimally distributed to the driven members depending on the loads of the driven members regardless of the operating states of the first driven member and the second driven member, the above-described driving force transmission device is particularly effective at the time of start-up or lower-speed driving requiring a great torque.

In the related-art mechanism in which the transmission mechanism of the first driven member and the transmission mechanism of the second driven member, the kinetic energy of the driven members is converted into heat energy and is uselessly consumed at the time of decelerating the first driven member or the second driven member. However, in the above-described driving force transmission device, at the time of decelerating one driven member, the kinetic energy of the driven member is used as the driving force of the other driven member. Accordingly, in the driving force transmission device, it is possible to effectively utilize the energy. It is also possible to reduce the power consumption at the time of deceleration.

(2) The driving force transmission device of (1) may further includes a first transmission mechanism, a second transmission mechanism, a third transmission mechanism, and a fourth transmission mechanism. The first transmission mechanism is provided in a path from the first rotation shaft to the first output shaft through the first input shaft and the transmission ratio thereof is "a." The second transmission mechanism is provided in a path from the second rotation shaft to the first output shaft through the second input shaft and the transmission ratio thereof is "b." The third transmission mechanism is provided in a path from the first rotation shaft to the second output shaft through the third input shaft and the transmission ratio thereof is "c." The fourth transmission mechanism is provided in a path from the second rotation shaft to the second output shaft through the fourth input shaft and the transmission ratio thereof is "d." Here, the transmission ratio denotes a value obtained by dividing the angular speed output from the transmission mechanism by the angular speed input to the transmission mechanism. Accordingly, for example, the transmission ratio of the first transmission mechanism denotes a value obtained by dividing the angular speed of the first-output shaft by the rotation shaft (rotation shaft input to the first rotation shaft) of the first motor. Needless to say, the transmission ratios satisfy the relation of ad−bc≠0.

Accordingly, the configuration in which the angular speed of the first output shaft is a sum of a times the angular speed of the first motor and b times the angular speed of the second motor and the angular speed of the second output shaft is a sum of c times the angular speed of the first motor and d times the angular speed of the second motor can be embodied.

(3) The driving force transmission device of (2), a may be a1·a2 when, in the first transmission mechanism, the transmission ratio of a path from the first rotation shaft to the first input shaft is a1 and the transmission ratio of the first differential unit is a2. b may be b1−b2 when, in the second transmission mechanism, the transmission ratio of a path from the second rotation shaft to the second input shaft is b1 and the transmission ratio of the first differential unit is b2. c may be c1·c2 when, in the third transmission mechanism, the transmission ratio of a path from the first rotation shaft to the third input shaft is c1 and the transmission ratio of the second differential unit is c2. d may be $d_1 \cdot d_2$ when, in the fourth transmission mechanism, the transmission ratio of a path from the second rotation shaft to the fourth input shaft is d1 and the transmission ratio of the second differential unit is d2. In this case, the relation of a1·a2·d1·d2·b1·b2·c1·c2≠0 is established between the transmission ratios.

(4) The relation of a=b and c=−d may be established between a, b, c, and d.

Accordingly, the inventive concept of the present invention can be suitably applied to a mechanism substantially alternately driving the first driven member and the second driven member.

(5) The driving force transmission device of (1) to (4) may further include a first rotation information acquiring unit which acquires rotation information of the first motor and a second rotation information acquiring unit which acquires rotation information of the second motor. In this case, a controller controls the first motor and the second motor in a feedback manner on the basis of the acquisition results of the first rotation information acquiring unit and the second rotation information acquiring unit. The inventive concept of the preset invention can be preferably applied to such feedback control.

(6) The driving force transmission device of (1) to (4) may further include a first position information acquiring unit which acquires position information of the first driven member and a second position information acquiring unit which acquires position information of the second driven member. In this case, a controller controls the first motor and the second motor in a feedback manner on the basis of the acquisition results of the first position information acquiring unit and the second position information acquiring unit. The inventive concept of the present invention can be preferably applied to this case.

(7) The above-described driving force transmission device of (1) to (6) can also be applied to an ink-jet print type image recording apparatus. In this case, the first driven member is a carriage reciprocating in a direction intersecting a conveyance direction of a recording medium. The second driven member is a conveyance roller conveying the recording medium to an image printing area by a print head. In the image recording apparatus, it is possible to most efficiently utilize the driving force of the motor.

According to the above-described configuration, it is possible to independently control the angular speeds of the first output shaft and the second output shaft, that is, the speeds of the first driven member and the second driven member. When the first motor and the second motor are driven in the state where one has a high load and the other has a low load, the driving force of the first motor and the second motor can be optimally distributed to the driven members, respectively, depending on the loads of the driven members, regardless of the operating states of the first driven member and the second driven member. Accordingly, it is possible to efficiently use the driving force of the first motor and the second motor without wasting. As a result, it is possible to obtain a desired rotation output without any increase in size of the motors.

As described above, since the driving force of the first motor and the second motor is optimally distributed to the driven members depending on the loads of the driven members regardless of the operating states of the first driven member and the second driven member, the driving force transmission device according to the invention is particularly effective at the time of start-up or lower-speed driving requiring a great torque.

At the time of decelerating one driven member, the kinetic energy of the driven member is used as the driving force of the other driven member. Accordingly, in the driving force transmission device, it is possible to effectively utilize the energy. It is also possible to reduce the power consumption at the time of deceleration.

What is claimed is:

1. A driving force transmission device for transmitting driving force of a first motor and a second motor, angular speeds of which are controlled independently, to a first driven member and a second driven member, the driving force transmission device comprising:

a first differential unit including:

a first input shaft connected to a first rotation shaft of the first motor;

a second input shaft connected to a second rotation shaft of the second motor; and a first output shaft connected to the first driven member; and a second differential unit including:

a third input shaft connected to the first rotation shaft of the first motor;

a fourth input shaft connected to the second rotation shaft of the second motor; and a second output shaft connected to the second driven member;

wherein an angular speed of the first output shaft is a sum of a times the angular speed of the first motor and b times the angular speed of the second motor, wherein an angular speed of the second output shaft is a sum of c times the angular speed of the first motor and d times the angular speed of the second motor, and wherein a, b, c and d satisfy a relation of $ad-bc\neq 0$.

2. The driving force transmission device according to claim 1, further comprising:

a first transmission mechanism provided in a path from the first rotation shaft to the first output shaft thorough the first input shaft and having a transmission ratio of a;

a second transmission mechanism provided in a path from the second rotation shaft to the first output shaft through the second input shaft and having a transmission ratio of b;

a third transmission mechanism provided in a path from the first rotation shaft to the second output shaft through the third input shaft and having a transmission ratio of c; and a fourth transmission mechanism provided in a path from the second rotation shaft to the second output shaft through the fourth input shaft and having a transmission ratio of d.

3. The driving force transmission device according to claim 2, wherein a is $a1\cdot a2$ when, in the first transmission mechanism, a transmission ratio of a path from the first rotation shaft to the first input shaft is a1 and a transmission ratio in the first differential unit is a2, wherein b is $b1\cdot b2$ when, in the second transmission mechanism, a transmission ratio of a path from the second rotation shaft to the second input shaft is b1 and a transmission ratio in the first differential unit is b2, wherein c is $c1\cdot c2$ when, in the third transmission mechanism, a transmission ratio of a path from the first rotation shaft to the third input shaft is c1 and a transmission ratio in the second differential unit is c2, and wherein d is $d1\cdot d2$ when, in the fourth transmission mechanism, a transmission ratio of a path from the second rotation shaft to the fourth input shaft is d1 and a transmission ratio in the second differential unit is d2.

4. The driving force transmission device according to claim 3, wherein the transmission ratios a2, b2, c2 and d2 satisfy relations of a2=b2and c2=d2.

5. The driving force transmission device according to claim 1, wherein a, b, c, and d satisfy relations of a=b and c=−d.

6. The driving force transmission device according to claim 1, further comprising:

a controller configured to control the first motor and the second motor;

a first rotation information acquiring unit configured to acquire rotation information of the first motor; and a second rotation information acquiring unit configured to acquire rotation information of the second motor, wherein the controller controls the first motor and the second motor in a feedback manner based on the rotation information of the first motor acquired by the first rotation information acquiring unit and the rotation information of the second motor acquired by the second rotation information acquiring unit.

7. The driving force transmission device according to claim 1, further comprising:

a controller configured to control the first motor and the second motor;

a first position information acquiring unit which acquires position information of the first driven member; and a second position information acquiring unit which acquires position information of the second driven member, wherein the controller controls the first motor and the second motor in a feedback manner based on the position information of the first driven member acquired by the first position information acquiring unit and the position information of the second driven member acquired by the second position information acquiring unit.

8. The driving force transmission device according to claim 1, wherein the first input shaft is directly connected to the first rotation shaft of the first motor, wherein the second input shaft is directly connected to a second rotation shaft of the second motor, wherein the third input shaft is directly connected to the first rotation shaft of the first motor, and wherein the fourth input shaft is connected to the second rotation shaft of the second motor through the second input shaft.

9. An image recording apparatus comprising:

a first motor;

a second motor;

a controller configured to control angular speeds of the first motor and the second motor;

a carriage which includes a print head and reciprocates in a first direction;

a conveyance roller which conveys a recording medium in a second direction intersecting the first direction to an image printing area of the print head;

a driving force transmission device for transmitting driving force of the first motor and the second motor to the carriage and the conveyance roller, the driving force transmission device including:

a first differential unit including:

a first input shaft connected to a first rotation shaft of the first motor;

a second input shaft connected to a second rotation shaft of the second motor; and a first output shaft connected to a driving mechanism of the carriage; and a second differential unit including:

a third input shaft connected to the first rotation shaft of the first motor;

a fourth input shaft connected to the second rotation shaft of the second motor; and a second output shaft connected to a driving mechanism of the conveyance roller;

wherein an angular speed of the first output shaft is a sum of a times the angular speed of the first motor and b times the angular speed of the second motor, wherein an angular speed of the second output shaft is a sum of c times the angular speed of the first motor and d times the angular speed of the second motor, and wherein a, b, c and d satisfy a relation of $ad-bc\neq 0$.

10. An image recording apparatus comprising:

a first motor;

a second motor;

a conveyance unit which conveys a recording medium in a conveying direction;

a carriage which reciprocates in a scanning direction intersecting the conveying direction and mounts thereon a print head for ejecting drops on the recording medium; and a driving force transmission device which generates a first driving force for the conveyance unit from a driving force of the first motor and a driving force of the second motor in conjunction with each other, and which generates a second driving force to the carriage from the driving force of the first motor and the driving force of the second motor in conjunction with each other, the second driving force being independent from the first driving force.

11. The image recording apparatus according to claim 10, wherein the driving force transmission device includes:

a first differential gear which is coupled to the first motor, the second motor and the carriage; and a second differential gear which is coupled to the first motor, the second motor and the conveyance unit.

* * * * *